US006592329B1

(12) United States Patent
Hirose et al.

(10) Patent No.: US 6,592,329 B1
(45) Date of Patent: Jul. 15, 2003

(54) ELECTRIC BLOWER AND VACUUM CLEANER USING IT

(75) Inventors: Toru Hirose, Osaka (JP); Hiroyuki Kayama, Osaka (JP); Tuyoshi Tokuda, Shiga (JP); Seiji Yamaguti, Shiga (JP); Seiichi Ueno, Shiga (JP); Yoshitaka Murata, Shiga (JP); Tsuyoshi Nishimura, Shiga (JP); Kazuhisa Morishita, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/700,134

(22) PCT Filed: May 12, 1999

(86) PCT No.: PCT/JP99/02437

§ 371 (c)(1),
(2), (4) Date: Dec. 21, 2000

(87) PCT Pub. No.: WO99/58857

PCT Pub. Date: Nov. 18, 1999

(30) Foreign Application Priority Data

| | | |
|---|---|---|
| May 13, 1998 | (JP) | 10-129882 |
| Jul. 17, 1998 | (JP) | 10-202985 |
| Jul. 31, 1998 | (JP) | 10-217238 |
| Jul. 31, 1998 | (JP) | 10-217239 |

(51) Int. Cl.[7] ..... F04D 29/30
(52) U.S. Cl. ..... 416/203
(58) Field of Search ..... 416/185, 186 R, 416/199, 203–223 B

(56) References Cited

FOREIGN PATENT DOCUMENTS

| | | | | |
|---|---|---|---|---|
| JP | 50-45309 | | 4/1975 | |
| JP | 59-103999 | | 6/1984 | |
| JP | 59103999 | A * | 6/1984 | ..... F04D/29/28 |
| JP | 59190497 | A * | 10/1984 | ..... F04D/29/28 |
| JP | 61-149304 | | 7/1986 | |
| JP | 2-199300 | | 8/1990 | |
| JP | 2-238196 | | 9/1990 | |
| JP | 2-122485 | | 10/1990 | |
| JP | 03138493 | A * | 6/1991 | ..... F04D/29/26 |
| JP | 4-121494 | | 4/1992 | |
| JP | 05010294 | A * | 1/1993 | ..... F04D/29/44 |
| JP | 5-202701 | | 8/1993 | |
| JP | 5-296193 | | 11/1993 | |
| JP | 6-81711 | | 3/1994 | |
| JP | 6-323060 | | 11/1994 | |
| JP | 7-83197 | | 3/1995 | |
| JP | 7-217004 | | 8/1995 | |
| JP | 7-253107 | | 10/1995 | |
| JP | 8-258218 | | 10/1996 | |
| JP | 8-303389 | | 11/1996 | |
| JP | 8-326176 | | 12/1996 | |
| JP | 8-334100 | | 12/1996 | |
| JP | 10-734 | | 1/1998 | |

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

An electric blower includes an electric motor having a rotating shaft and an impeller fixed to the rotating shaft for rotation. The impeller has a rear shroud fixed to the rotating shaft, a front shroud which faces the rear shroud and has an inlet hole to take in air, a plurality of blades disposed between the rear shroud and the front shroud, and an inducer which streamlines air flowing from the inlet hole and has a three dimensional-shaped vane. The inducer is formed separately from the blade and is disposed between the rear shroud and the front shroud, whereby an electric blower that is simple in structure, lower in clearance between parts, higher in strength, and lower in air loss is realized. Also, a practicable vacuum cleaner high in sucking performance is realized by the utilization of the electric blower.

58 Claims, 44 Drawing Sheets

(a)

(b)

(a)

(b)

(a)

(b)

(a)

(b)

(a)

(b)

$Rs \geqq Ri$ $Hi \geqq Hb$

ELECTRIC BLOWER AND VACUUM CLEANER USING IT

FIELD OF THE INVENTION

The present invention relates to an electric blower and a vacuum cleaner using the electric blower.

BACKGROUND OF THE INVENTION

A conventional electric blower is described with reference to FIG. 46.

Impeller 1 comprises rear shroud 2, front shroud 3 which faces the rear shroud 2, and a plurality of blades 4 disposed between the pair of shrouds 2, 3. Inducer part 5 defines an extending part on inlet hole 13 side of blades 4 and a three-dimensional-shaped curved surface, while the outer periphery of blade 4 has a two-dimensional-shaped curved surface. Electric motor 6 drives impeller 1. Air guide 7 having a plurality of stationary blades 8 defines a volute chamber between adjacent stationary blades 8. Fan case 10 includes impeller 1 and air guide 7, is airtightly mounted to the outer periphery of electric motor 6, and has an intake opening 11 in its central part.

An operation in this structure is described. When impeller 1 is rotated by electric motor 6 at a high speed, air flow is sucked from inlet hole 13 of impeller 1, travels through blades 4 without being disturbed by inducer part 5, and is exhausted from the outer periphery of impeller 1. The air flow axially comes into inlet hole 13, but goes out from an outlet of impeller 1 in the centrifugal direction, namely orthogonally to the axial direction. The direction of the air flow changes along the three-dimensional-shaped curved surface of inducer part 5. The air flow further travels through the volute chamber formed from the plurality of stationary blades 8 mounted to air guide 7, and goes into electric motor 6.

As problems of this conventional electric blower, it is difficult to manufacture and has poor productivity because blades 4 include complex-shaped inducer part 5 having the three-dimensional-shaped curved surface. When the blades 4 are manufactured in a cutting work, a very long working time is required, and even when it is manufactured in a molding work, a special manufacturing method is required which makes the blades expensive. A method in which blades 4 are assembled separately from inducer part 5 is also proposed, but there are many requirements, such as easy manufacturing of inducer 5, joining of inducer 5 to blades 4 so that there is less air leakage and without causing air resistance, and fixing of the inducer 5 that it withstands high speed rotation and does not cause any air leakage between both shrouds 2, 3 and the inducer 5. Therefore, this method has not yet commercialized.

DISCLOSURE OF THE INVENTION

The present invention addresses the problems discussed above and aims to provide an electric blower. In this electric blower, a blade of an impeller is divided as a two-dimensional curved-surface-shaped blade and a three-dimensional curved-surface-shaped inducer, and they are constituted as separate components. In addition, problems of strength, clearance, and air resistance are solved, the manufacturing method is simple, and loss is reduced.

For solving the problems discussed above, the electric blower in accordance with the present invention and a vacuum cleaner using it include an electric motor having a rotating shaft and an impeller fixed to the rotating shaft for rotation. The impeller comprises the following elements:

- a rear shroud fixed to the rotating shaft;
- a front shroud that faces the rear shroud and has an inlet hole to take in air;
- a plurality of blades disposed between the rear shroud and the front shroud; and
- an inducer which streamlines air flowing from the inlet hole and has a three-dimensional-shaped vane.

The inducer is formed separately from the blade. Thus, a practical electric blower that is simple in structure, least in clearance between parts, higher in strength, lower in loss is realized. An efficient vacuum cleaner high in sucking capacity is realized by the utilization of the electric blower.

A first embodiment of the present invention is an electric blower comprising an electric motor having a rotating shaft and an impeller fixed to the rotating shaft for rotation. The impeller comprises the following elements:

- a rear shroud fixed to the rotating shaft;
- a front shroud that faces the rear shroud and has an inlet hole to take in air;
- a plurality of blades disposed between the rear shroud and the front shroud; and
- an inducer which streamlines air flowing from the inlet hole and has a three-dimensional-shaped vane. The inducer is formed separately from the blade and is placed between the rear shroud and the front shroud. The impeller that includes the inducer having a complex shape and has no problem in strength is realized in a simple and mass-producible method. As a result, a downsized, powerful, and highly efficient electric blower can be provided in a lower price.

A second embodiment of the present invention is an electric blower according to the first embodiment, wherein a rear shroud and a front shroud are respectively formed from sheet metals, and an inducer is formed from a moldable material. The high-performance electric blower can be realized in a lower price similar to the first embodiment, by forming the inducer in a resin molding and constituting blades and shrouds with sheet metals.

A third embodiment of the present invention is an electric blower according to the second embodiment, wherein an inducer is molded using a plurality of divided dies that slide substantially radially. The resin made inducer has a shape such that it can be manufactured with slide dies, and therefore, the electric blower having higher mass-productivity can be realized.

A fourth embodiment of the present invention is an electric blower according to the second embodiment or the third embodiment, wherein a number of vanes and a number of the blades are respectively equal to six. The highest efficient condition is selected, and therefore, the highly efficient electric blower having higher mass-productivity can be realized.

A fifth embodiment of the present invention is an electric blower according to the third embodiment, wherein the direction of a line between a point at the tip of a vane of an inducer and a point moved by a clearance from the end of the outer periphery of the vane is matched to a sliding direction of a die. The resin made inducer can be molded in a simple die structure, and the highly efficient electric blower having higher mass-productivity can be realized.

A sixth embodiment of the present invention is an electric blower according to one of the second embodiment to the fifth embodiment, wherein an inducer comprises a substantially conical hub and a plurality of vanes that are fixed to the outer periphery of the hub and have a three-dimensional-shaped curved surface. Furthermore, a parting line generated during molding is formed so that the upstream side of air flow is higher and the downstream side is lower. The electric blower in which resistance of air flow is reduced and efficiency is higher can be realized since the parting line of the inducer that is generated during molding has a step where the upstream side of air flow is higher and the downstream side is lower.

A seventh embodiment of the present invention is an electric blower according to one of the second embodiment to the sixth embodiment, wherein a connecting portion for connecting with the end of a blade is placed at the blade-side end of an inducer. The connecting portion is placed on the inducer for connecting a vane of the resin-made inducer with the blade formed from a sheet metal, leakage of air flow from a joint portion is reduced, and the highly efficient electric blower can be realized.

An eighth embodiment of the present invention is an electric blower according to the seventh embodiment, wherein a recessed part for receiving an end of the blade is drilled in a connecting portion. The electric blower in which leakage is further reduced and an impeller is easily assembled can be realized since the connecting portion of an inducer has a recessed shape.

A ninth embodiment of the present invention is an electric blower according to the eighth embodiment, wherein an end of a metallic blade is pressed into the recessed part. Because the vanes of an inducer are joined with the blade in pressing-in and grabbing methods, the blade can be held together with the inducer during the assembling work of an impeller, and the electric blower easy in assembling work, less in loss, and high in assembling workability can be realized.

A tenth embodiment of the present invention is an electric blower according to the seventh embodiment, wherein the connecting portion is brought into contact with a reversely-rotated side surface of the end of a blade. The connecting portion abuts to one side of the blade, and the abutting direction is matched to the pressure-contact direction of the blade with rotation of an impeller. Thus, resistance of flow is reduced, a joint with reduced leakage is produced, and therefore, the highly efficient electric blower can be realized.

An eleventh embodiment of the present invention is an electric blower according to the seventh embodiment, wherein the connecting portion and the inlet-side end of a blade are integrally formed. Since the connecting portion and the inlet-side end of the sheet-metal-made blade are integrally formed, the assembling is noticeably facilitated, resistance and leakage of air flow can be extremely reduced, and therefore the highly efficient electric blower having higher mass-productivity can be realized.

A twelfth embodiment of the present invention is an electric blower according to the second embodiment, wherein an inducer comprises a hub and a plurality of vanes that are fixed to the outer periphery of the hub and have a three-dimensional-shaped curved surface, an engaging portion is formed on a rear shroud side of the hub, and an engaged portion for engaging with the engaging portion is formed on the rear shroud. The engaging portion is formed on the rear surface shroud side of the hub, and the engaged portion is formed on the rear surface shroud to allow positioning of the inducer, and a clearance between the vanes formed on the inducer and a metal-board-made blade can be reduced. Thus, because the occurrence of loss caused by leakage of air flow to adjacent passages in the impeller can be restrained and pressure can be raised smoothly, the electric blower higher in sucking performance can be realized.

A thirteenth embodiment of the present invention is an electric blower according to the twelfth embodiment, wherein an engaging portion is formed as a boss and the engaged portion is formed as a hole. Because a plurality of bosses capable of engaging with a plurality of holes formed in the rear shroud are deposited on the rear shroud side of a hub of an inducer, a clearance between a vane formed on the inducer and a plate-metal-made blade can be reduced, and an effect as discussed above is obtainable.

A fourteenth embodiment of the present invention is an electric blower according to the twelfth or thirteenth embodiment, wherein a number of engaging portions and a number of engaged portions are respectively equal to a divisor of the number of the blades or the vanes. The number of bosses formed on the rear shroud side of the hub of the inducer and the number of the holes formed in the rear shroud are respectively set equal to the divisor of number of the blades or the vanes. Therefore, the positions of each vane and each blade are matched with each other even if the inducer is embedded at any angle, a clearance between the vane and the blade can be reduced, an effect as discussed above is obtainable, and assembling ability is improved.

A fifteenth embodiment of the present invention is an electric blower according to the second embodiment, wherein an inducer comprises a hub and a plurality of vanes that are fixed to the outer periphery of the hub and have a three-dimensional-shaped curved surface, and a space portion is formed on the rear shroud side of the hub so that thickness of the hub is substantially uniform. Since the space portion is placed on the side abutting to the rear shroud of the hub constituting the inducer so that thickness of the hub is substantially uniform, an inducer that is prevented from deforming due to resin's distortion occurring during molding and is accurate in size can be realized. Thus, a clearance at a connecting portion between the vane and a blade can be also reduced, and the effect as discussed above is obtainable.

A sixteenth embodiment of the present invention is an electric blower according to the fifteenth embodiment, wherein a plurality of ribs are radially placed in a space portion on a hub of an inducer so as to connect with a boss portion formed in the center of the inducer. Since the ribs are radially placed in the space portion formed on a hub of the inducer, strength of the inducer is increased, positioning and fixing of the inducer are certainly performed during assembling, and the effect as discussed above is obtainable. In addition, centrifugal force and torsion during high speed rotation of an impeller can be prevented from causing deformation or damage of a vane, and the highly reliable inducer can be realized.

A seventeenth embodiment of the present invention is an electric blower according to the sixteenth embodiment, wherein a boss capable of engaging with a hole formed in a rear shroud is formed on at least one of ribs placed in a space portion formed on a hub of an inducer. Thus, strength of the boss is increased, positioning and fixing of the inducer can be certainly performed, and the effect as discussed above is obtainable.

An eighteenth embodiment of the present invention is an electric blower according to the thirteenth embodiment, wherein a tilting portion is formed at the tip of a boss, outer diameter of the root portion of the tilting portion of the boss is made smaller than the diameter of a hole drilled in a rear shroud, and the outer diameter of the root portion of the boss is made larger than the diameter of the hole. Since the tilting portion is formed at the tip of the boss and is made smaller than the outer diameter of the hole, the boss is easily inserted during mounting of an inducer. When the insertion is finished, the inducer is tightly fixed in a state that the root portion of the boss is pressed into the hole. As a result, assembling ability can be further improved, and positioning and fixing of the inducer can be performed.

A nineteenth embodiment of the present invention is an electric blower according to the thirteenth embodiment, wherein a plurality of long holes are drilled in a rear shroud, maximum diameter portion of one of the long holes is made larger than the diameter of a boss, and minimum diameter portion of the other of the long holes is made smaller than the diameter of the boss. Since the plurality of long holes are drilled in the rear shroud, the maximum diameter portion of one of the long holes is made larger than the diameter of the boss, and the minimum diameter portion of the other of the long holes is made smaller than the diameter of the boss, the boss formed on a hub is pressed into the minimum diameter portion by inserting the boss into the hole having the maximum diameter and then rotating an inducer. Therefore, assembling ability can be further improved.

A twentieth embodiment of the present invention is an electric blower according to the second embodiment, wherein recessed parts capable of engaging with a plurality of projecting parts formed on a rear shroud are drilled in a bottom surface of a hub of an inducer which faces the projecting parts. Since the recessed parts are drilled in the bottom surface of the hub of the inducer which faces the projecting parts formed on the rear shroud, the effect as discussed above is obtainable.

A twenty-first embodiment of the present invention is an electric blower according to the second embodiment, wherein a projection is formed on at least one of the upper part and the lower part of the rear edge of a vane of an inducer, an engaging portion capable of joining to the projection is formed at the front edge of a blade, a front shroud and a rear shroud are fixed by simultaneously crimping the projection and the engaging portion. Positioning of the vane of the inducer and the blade can be further performed with certainty.

A twenty-second embodiment of the present invention is an electric blower according to the twelfth embodiment, wherein a boss placed on a hub of an inducer is higher than an engaging portion formed on a blade. Because the boss placed on the hub of the inducer is inserted into a rear shroud prior to the engaging portion formed on the blade, assembling ability of an impeller can be extremely improved.

A twenty-third embodiment of the present invention is an electric blower according to the second embodiment, wherein a through hole is drilled in a position of a front shroud that faces a joint portion between the end of a blade and the end of a vane of an inducer. Because an adhesive can be put through the through hole after assembling of an impeller, a micro clearance of the joint portion can easily be filled. Therefore, occurrence of loss caused by leakage of air flow to adjacent passages in the impeller is restrained, and pressure can be smoothly raised. As a result, the electric blower higher in sucking performance can be realized.

A twenty-fourth embodiment of the present invention is an electric blower according to the second embodiment, wherein a plurality of engaging portions for engaging with a front shroud and a rear shroud are disposed on a blade and at least one of the engaging portions is placed at the inducer side end of the blade. After assembling of the impeller, an adhesive can be made to flow from the engaging portion placed at the inducer side end of the blade and along a joint portion between the blade and a vane, and a micro clearance can be filled easily and certainly. As a result, workability can be improved, and the effect same as that discussed above is obtainable.

A twenty-fifth embodiment of the present invention is an electric blower according to the second embodiment, wherein the distance between the front edge of a blade and the end of an engaging portion formed on the central side of the blade is set shorter than 5 mm. An engaged portion on the central side that is formed in a front shroud can be shifted slightly to the outer periphery side, and the engaging portion and the engaged portion are joined to each other at a slightly moderated curved-shaped part of the front shroud. Therefore, joint strength between the blade and the shroud is increased, and the effect as discussed above is obtainable.

A twenty-sixth embodiment of the present invention is an electric blower according to the twenty-fourth or twenty-fifth embodiment, wherein an engaged portion that can be engaged with an engaging portion on the central side of a blade and is formed in a front shroud is extended toward a suction opening of an impeller. An injection opening of an adhesive is formed in the engaged portion on the central side of the front shroud. The adhesive can be easily made to flow, workability is improved, and the effect as discussed above is obtainable.

A twenty-seventh embodiment of the present invention is an electric blower according to one of the twenty-third to twenty-sixth embodiments, wherein a groove extending from a front shroud to a rear shroud is formed in the end of the rear edge of a vane of an inducer which joins to the front edge of a blade. An adhesive can be made to flow in along the groove, a clearance in a joint portion between the vane and the blade can be certainly filled, occurrence of loss caused by leakage of air flow to adjacent passages in an impeller can be restrained, and pressure can be raised smoothly. As a result, the electric blower higher in sucking performance can be realized.

A twenty-eighth embodiment of the present invention is an electric blower according to the twenty-seventh embodiment, wherein a desired space connected with a groove formed in the end of the rear edge of a vane is placed on the bottom of an inducer. An adhesive can be certainly made to flow into a joint portion between the vane and a blade after assembling of an impeller, and the adhesive, even if it is somewhat excessively made flow, is accumulated in the desired space without going to a place that requires no adhesive. Therefore, a clearance can be effectively filled, and the effect as discussed above is obtainable.

A twenty-ninth embodiment of the present invention is an electric blower according to the second embodiment, wherein a groove is formed from the end to the rear edge of a vane of an inducer that abuts to a front shroud. Not only a joint portion between the vane and a blade, but also a micro clearance in the joint portion between the vane and the front shroud can be filled, occurrence of loss caused by leakage of air flow to adjacent passages in an impeller can be certainly restrained, and pressure can be raised smoothly. As a result, the electric blower higher in sucking performance can be realized.

A thirtieth embodiment of the present invention is an electric blower according to the second embodiment, wherein a through hole is drilled in a position of a rear shroud that corresponds to a joint portion between the end of a blade and the end of a vane of an inducer. When an adhesive is made to flow in through the through hole in the rear shroud, it flows to the joint portion between the blade and the vane and flows to a joint portion between the vane and a front shroud. Therefore, a clearance can be easily filled, workability is improved, and the effect as discussed above is obtainable.

A thirty-first embodiment of the present invention is an electric blower comprising the following elements:

a rear shroud fixed to the rotating shaft of an electric motor;

a front shroud that faces the rear shroud;

a plurality of blades disposed between the pair of shrouds;

an inducer having a plurality of three-dimensional-shaped vanes extending from this blade toward the inlet of an impeller;

a hub defining a base of this inducer; and a substantially L-shaped notch formed in the root part on the outer periphery side of the vane, of a joint portion between the front edge of the blade and the rear edge of the vane.

The joint portion can abut to a side surface as well as the end surface of the front edge of the blade, and leakage of air flow can be reduced at the joint portion. Since the notch is substantially L-shaped, assembling is facilitated, workability is not lost, and the effect as discussed above is obtainable.

A thirty-second embodiment of the present invention is an electric blower according to the thirty-first embodiment, wherein a flash is formed at the end of a vane joining with a front shroud of an inducer. Since the flash is formed at the end of the vane joining with the front shroud of the inducer, and an impeller is assembled crushing the flexible and thin flash with pressurization during assembling of the impeller, a clearance in a joint surface can be easily closed, and the effect as discussed above is obtainable.

A thirty-third embodiment of the present invention is an electric blower according to the thirty-first embodiment, wherein a micro rib is formed at the front-shroud-side end of a vane of an inducer. Since the micro rib is formed at the end of the vane which joins with the front shroud of the inducer, the flexible micro rib is crushed with pressurization during assembling of an impeller to fill a clearance in a joint surface, and the effect as discussed above is obtainable.

A thirty-fourth embodiment of the present invention is an electric blower according to the thirty-third embodiment, wherein radius Rs of a curved surface of a front shroud which joins with a curve of a vane formed on an inducer and radius Ri of the curve of the vane are set to have the relation $Ri \leqq Rs$. Since the radius of the curved surface of the front shroud is larger, the front shroud abuts to the periphery of the curve of the vane when the front shroud is pressurized during assembling of an impeller. A clearance in a joint portion can be reduced, and the effect as discussed above is obtainable.

A thirty-fifth embodiment of the present invention is an electric blower according to the thirty-fourth embodiment, wherein height Hi of the rear edge of a vane formed on an inducer and height Hb of the front edge of a blade which joins with the rear edge of the vane is set to have the relation $Hi \geqq Hb$. Because a front shroud joins to the vane always prior to the blade, no clearance occurs, and the effect as discussed above is obtainable.

A thirty-sixth embodiment of the present invention is an electric blower according to the first embodiment, wherein a front shroud, a rear shroud, an inducer, vanes, and blades are adhered to one another by coating joint surface among them with adhesives. Because clearances that are in each joint portion between the components and are caused by size variation of the components of an impeller can be filled with the adhesives, air leakage from the front or rear part of the blade in the impeller is prevented to improve performance of the impeller.

A thirty-seventh embodiment of the present invention is an electric blower according to the first embodiment, wherein a rear shroud and a front shroud are formed from metal plates and are coated with a coating which melts by heating and gives an adhering effect, namely heating, melting and inter-adhering are performed during an assembling process. Since the front shroud and the rear shroud are previously coated with a coating which melts by heating and gives an adhering effect, the joint portion can be filled by simultaneously heating them during a crimping process of the front and rear shrouds and a blade. Therefore, workability is further improved, and the effect as discussed above is obtainable.

A thirty-eighth embodiment of the present invention is an electric blower according to the thirty-seventh embodiment, wherein an electrostatic coating method or an electrodeposition coating method is used as a coating means. Because an entire impeller can be uniformly coated by employing a coating method using an electrostatic or electrodeposition approach, a clearance can be certainly filled without problem such as reduction of workability or increase of unbalance. Therefore, the effect as discussed above is obtainable.

A thirty-ninth embodiment of the present invention is an electric blower according to the first embodiment, wherein a seal member slidably abutting to an inlet hole of a front shroud is placed on the inner surface of a fan case that faces the inlet hole. Because the seal member is placed in a casing and a suction opening in the front shroud slidably abuts to it to prevent circulation flow, performance of an impeller can be further improved.

A fortieth embodiment of the present invention is an electric blower according to the thirty-ninth embodiment, wherein a part slidably abutting to a seal member in a front shroud and its proximity are not coated. Paint is not put near a suction opening of the front shroud that slidably abuts to the seal member disposed in a casing. Therefore, an increase of frictional resistance due to slidable contact is restrained, and performance of an impeller can be further improved.

A forty-first embodiment of the present invention is a vacuum cleaner having a dust collector for collecting dust, a suction portion communicating with the dust collector, and the electric blower according to one of the first to fortieth embodiments. A highly-effective vacuum cleaner higher in sucking performance can be realized by using the electric blower discussed above for the vacuum cleaner.

BRIEF DESCRIPTION OF THE DRAWINGS

FIG. 5(*b*) is a side view showing the same operation in FIG. 5(*a*).

FIG. 7(*b*) is an enlarged view of X part in FIG. 7(*a*).

FIG. 8(*b*) is an enlarged sectional view of a parting line portion of the same impeller in FIG. 8(*a*).

FIG. 9(*b*) is a side view showing the same operation in FIG. 9(*a*).

FIG. 10(*b*) is an enlarged plan view of a connecting part between a blade and an inducer in the same impeller in FIG. 10(*a*).

FIG. 10(*c*) is an enlarged sectional view of the same connecting part in FIG. 10(*b*).

FIG. 11(*b*) is an enlarged sectional view of the same connecting part in FIG. 11(*a*).

FIG. 12(*b*) is an enlarged sectional view of the same connecting part in FIG. 12(*a*).

FIG. 12(*c*) is an enlarged plan view of the same connecting part before pressing into in FIG. 12(*a*).

FIG. 13(*b*) is an enlarged sectional view of the same connecting part in FIG. 13(*a*).

FIG. 14(*b*) is an enlarged sectional view of the same connecting part in FIG. 14(*a*).

FIG. 23(*b*) is an enlarged sectional view of an important part (after crimping) of the same impeller in FIG. 22.

FIG. 31(*b*) is an enlarged sectional view of an important part of the same impeller in FIG. 30.

FIG. 35(*b*) is a partial and horizontal sectional view of an assembling state of the end of the same inducer in FIG. 35(*a*) and a blade.

PREFERRED EMBODIMENTS OF THE INVENTION

Figure 1:
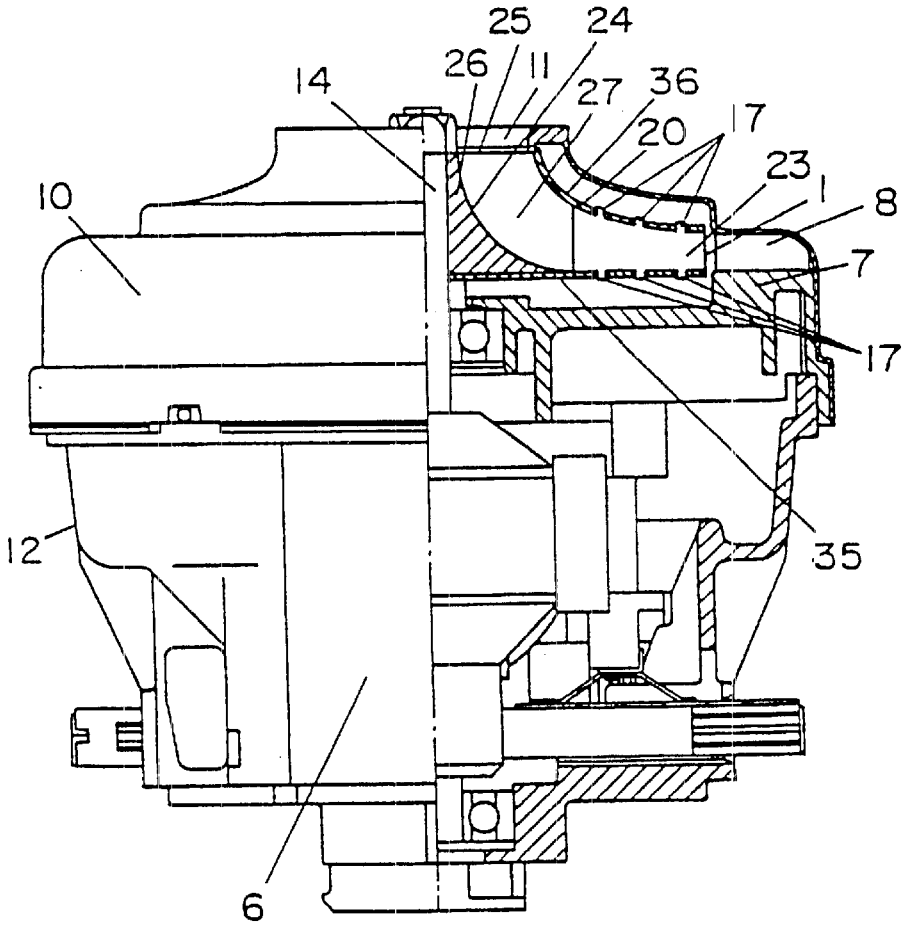
FIG. 1 is a partially-broken side view of an electric blower in accordance with a first exemplary embodiment of the present invention.
Figure 2:
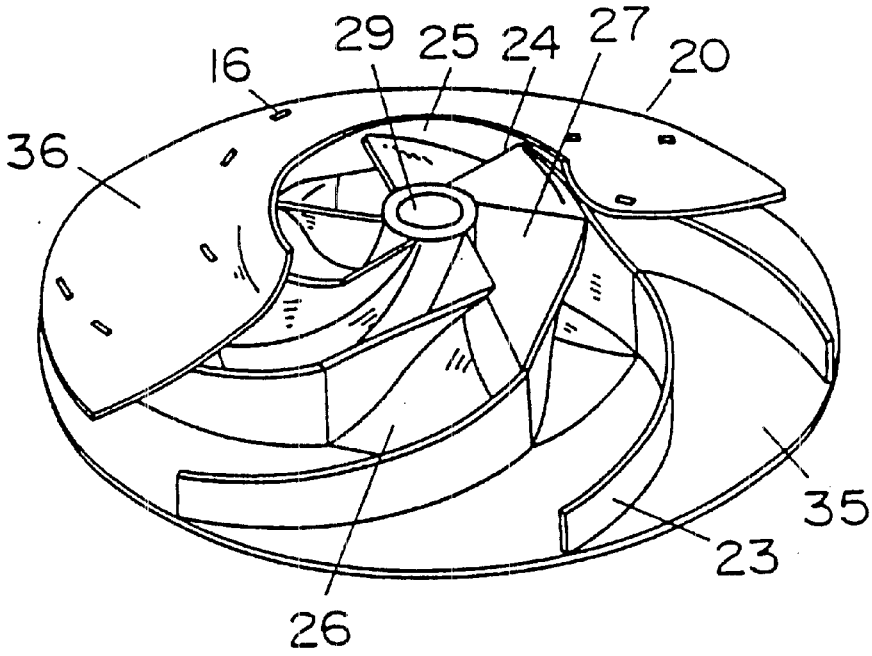
FIG. 2 is a partially-cut away perspective view of an impeller for the same electric blower in FIG. 1.

The first embodiment of the present invention is described hereinafter with reference to FIG. 1 to FIG. 3. In the description, the same elements used in the prior art are denoted with the same reference numbers, and are, not described. FIG. 1 is a half sectional view of an electric blower, impeller 20 is mounted to rotating shaft 14 of electric motor 6. A distinctive element in this embodiment is impeller 20, and is described hereinafter. FIG. 2 is a partially-cut away perspective view of impeller 20, and FIG. 3 is a sectional view of impeller 20.

Figure 3:
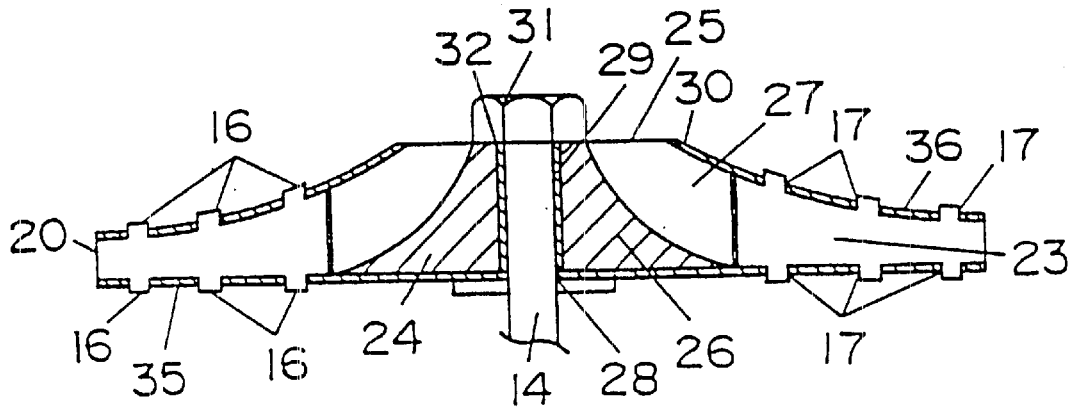
FIG. 3 is a sectional view of the same impeller in FIG. 2.

In FIG. 2 and FIG. 3, impeller 20 comprises the following elements: sheet-metal-made rear shroud 35; sheet-metal-made front shroud 36 placed away from rear shroud 35; a plurality of sheet-metal-made blades 23 that are grabbed between the pair of shrouds 35, 36 and have a two-dimensional curved shape; and resin-made inducer 24 disposed at inlet hole 25 of front shroud 36. For mounting sheet-metal-made blades 23 to each of shrouds 35, 36, crimp machining is employed. Resin made inducer 24 comprises a substantially conical hub 26 portion and a vane 27 portion formed on hub 26. An important function of the inducer is to smoothly feed air taken through inlet hole 25 to the sheet-metal-made blades 23 sidle without causing turbulence of flow. For realizing this function, vane 27 has a three-dimensional-shaped curved surface and is formed in resin molding in the present embodiment.

Assembling of impeller 20 and its mounting to rotating shaft 14 of electric motor 6 are described hereinafter. In FIG. 3, shaft hole 28 through which rotating shaft 14 is penetrated is formed in the center of rear shroud 35. Shaft hole 29 through which rotating shaft 14 is inserted is also formed in the center of hub 26 of inducer 24. Inducer 24 is placed on rear shroud 35 so as to match shaft hole 28 to shaft hole 29, and front shroud 36 is formed so as to abut to the entire region of upper end surface 30 of vane 27 of inducer 24. In other words, both shrouds 35, 36 are crimped and fixed to each other through blade 23, and simultaneously, inducer 24 is abutted against, urged, grabbed, and fixed by both shrouds 35, 36. Namely, by inserting a plurality of engaging portions 16 formed on blade 37 into square-hole-shaped engaged portions 17 formed in both shrouds 35, 36, and crushing the tip of engaging portions 16, blade 37 is fixed to both shrouds 35, 36.

Thus, since both shrouds 35, 36 are constituted so as to inducer 24 that is molded from resin, strength capable of resisting a centrifugal force during high speed rotation is obtainable, and shaft cores of inducer 24 and both shrouds 35, 36 are easily matched with each other. Impeller 20 is fixed by screwing the rear shroud with rotating shaft 14 via inducer 24. At this time, inducer 24 itself, because it is urged and fixed by both shrouds 35, 36, is not required to be directly fixed to rotating shaft 14. When impeller 20 is screwed with the rotating shaft via resin-made inducer 24 using nut 31, the nut may be loosened with plastic deformation of resin. Preferably, metallic cylindrical sleeve 32 is inserted into shaft hole 29 drilled in hub 26, and rear shroud 35 is screwed with rotating shaft 14 via cylindrical sleeve 32 using nut 31.

Inducer 24 hardly receives rotating force due to its small diameter, and therefore, can be sufficiently fixed in the rotational direction only by urging and grabbing it with both shrouds 35, 36. Because rear shroud 35 and rotating shaft 14 are fastened by nut 31, adhesion between cylindrical sleeve 32 and hub 26 of inducer 24 is not required to be worried about. So the structure becomes simple. In addition, by cutting slender grooves in the outer surface of cylindrical sleeve 32 and pressing cylindrical sleeve 32 into shaft hole 29 in inducer 24, the fixing of inducer 24 in the rotation direction is further ensured.

Thus, the impeller for the electric blower according to the present embodiment provides strength and accuracy capable of resisting high speed rotation thanks of the following reasons:

- the structure of inducer 24 is simplified by separating inducer 24 having a three-dimensional curved surface from a two-dimensional-curve-shaped blade 23; and
- the strength of vane 27 of inducer 24 is increased and the mounting accuracy of inducer 24 is also high by grabbing and fixing inducer 24 with both shrouds 35, 36.

Regarding the matching of the shaft core to the rotating shaft, accuracy of the shaft core with rotating shaft 14 is obtained by means of shaft hole 28 of rear shroud 35 and not shaft hole 29 of inducer 24. Therefore, rotation accuracy of both shrouds 35, 36 and blade 23 whose outer diameters are larger than that of inducer 24 is insured. In the present embodiment, since sheet metals are used for large diameter portions, namely both shrouds 35,36 and blade 23, and crimp machining is used for their mounting, high strength is obtainable and a problem related to strength does not occur even if inducer 24 is resinated.

Thus, the small and high power electric blower is obtainable that has a simple manufacturing method the insured strength and accuracy which can accommodate the high speed rotation, and good efficiency.

The second embodiment of the present invention is described hereinafter with reference to FIG. 4 to FIG. 6. In the description, the same elements used in the prior art and embodiment 1 are denoted with the same reference numbers, and are not described.

Figure 4:
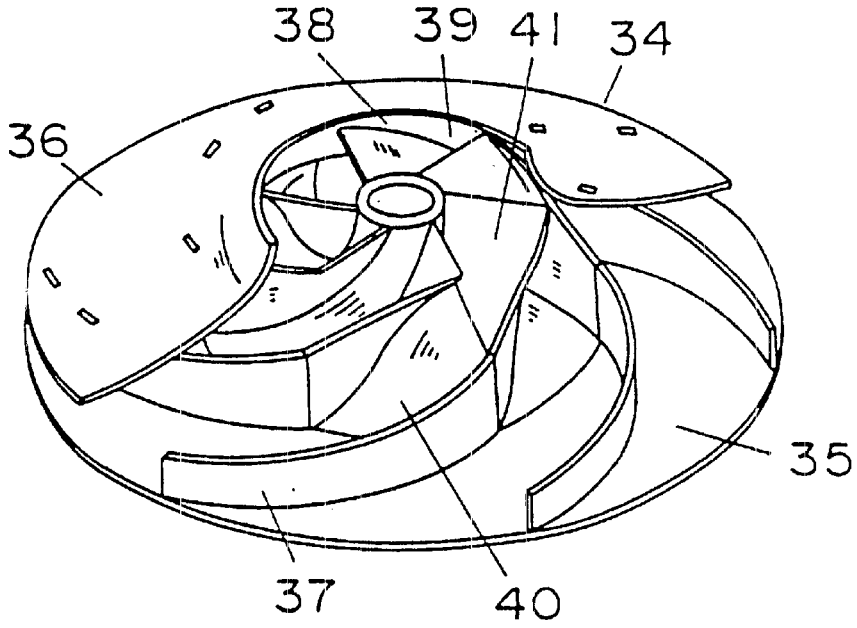
FIG. 4 is a partially-cut away perspective view of an impeller for an electric blower in accordance with a second exemplary embodiment of the present invention.

FIG. 4 is a partially-cut away perspective view of impeller 34. Impeller 34 comprises the following elements: sheet-metal-made rear shroud 35; sheet-metal-made front shroud 36 placed away from rear shroud 35; a plurality of sheet-metal-made blades 37 that are grabbed between the pair of shrouds 35,36; and resin-made inducer 39 corresponding to inlet hole 25 drilled in the center of front shroud 36. Sheet-metal-made blades 37 are mounted to each of shrouds 35, 36 with crimp machining. Resin-made inducer 39 comprises substantially conical hub 40 and vane 41 formed on hub 40. Vane 41 has the shape of a three-dimensional curved surface, especially for streamlining air flowing from inlet hole 25 to sheet-metal-made blade 37 side.

Figure 5:
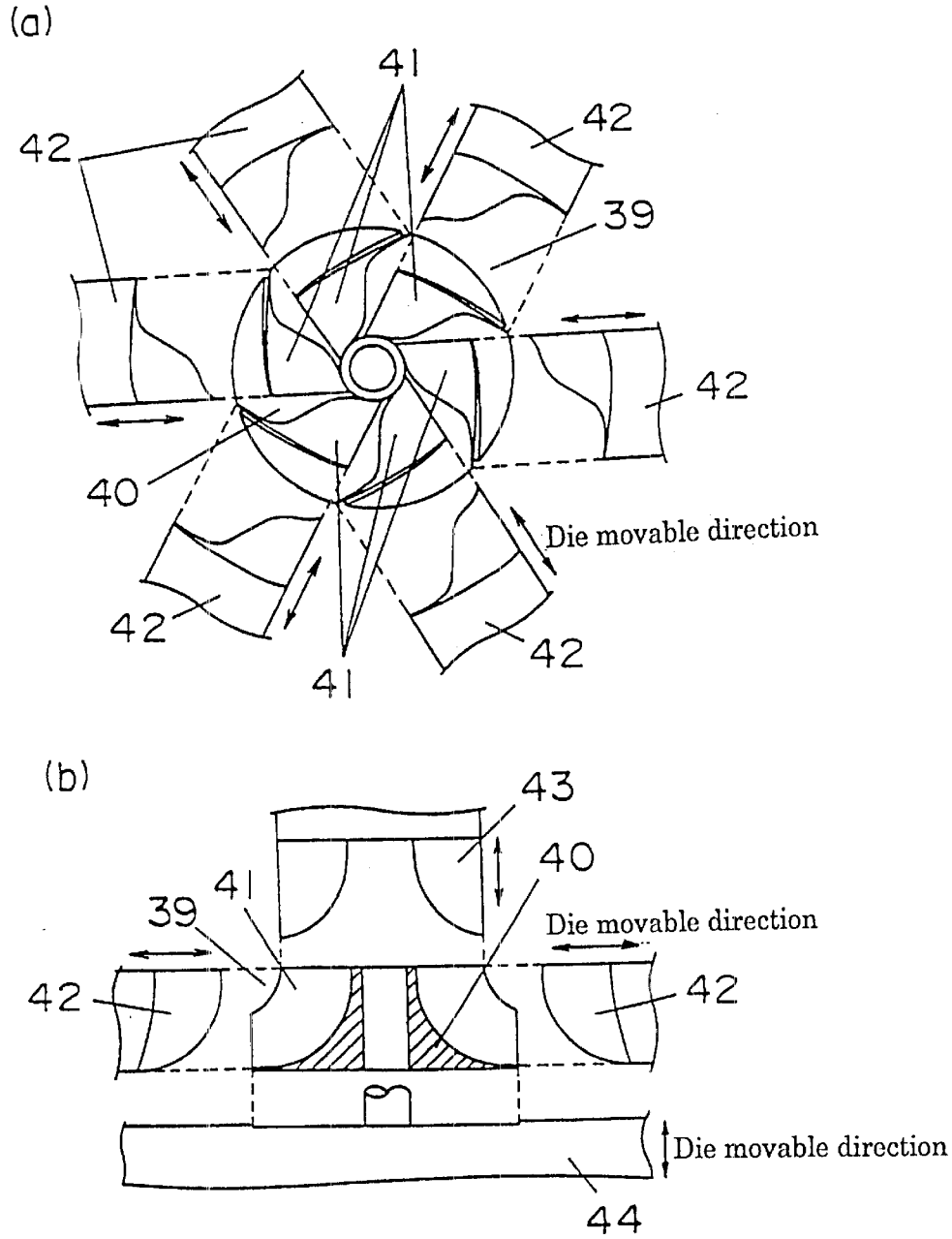
FIG. 5(*a*) is a plan view showing an operation of a die during molding of a resin-made inducer in the same impeller in FIG. 4.
Figure 6:
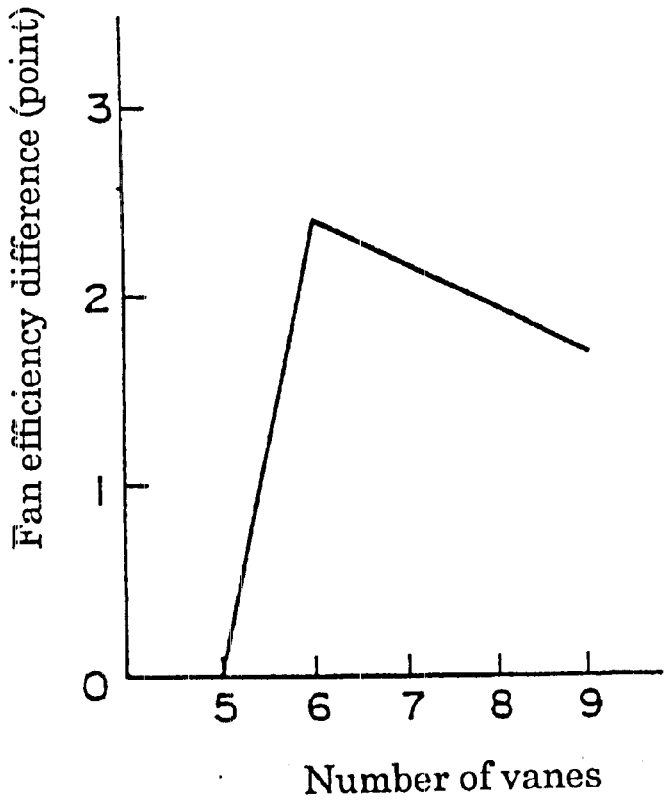
FIG. 6 shows a relation between a number of vanes of the same impeller in FIG. 4 and efficiency.

FIGS. 5(*a*) and (*b*) show an operation of a die during molding of inducer 39. For forming a complex-shaped inducer 39 discussed above, the molding die comprises a same number of side slide dies 42 as that of vanes 41, one upper slide die 43, and one lower slide die 44. Side slide dies 42 are slid sutantially radially in the circumferential direction of vane 41 of inducer 39. Slide dies 42,43, 44 in FIGS. 5(*a*) and (*b*) substantially show the appearance shapes.

In the operation in the structure discussed above, impeller 34 rotates at a high speed, and air flow is sucked from inlet hole 25 of impeller 34. This air flow travels through an inner passage surrounded with front shroud 36 and resin-made inducer 39, then travels through an inner passage surrounded with rear and front shrouds 35,36 and sheet-metal-made blade 37, and goes out from the outer periphery of impeller 34. At this time, the air flow direction smoothly changes along vane 41 from the shaft direction of impeller 34 to the direction orthogonal to the shaft to raise pressure in an adjacent passage.

Thus, in impeller 34 for the electric blower according to the present embodiment, inducer 39 that is placed near inlet hole 25 and has a three-dimensional curved surface can be formed without employing complex dies. That is because impeller 34 is divided into resin-made inducer 39 and sheet-metal-made blade 37, and resin-made inducer 39 has a shape capable of being molded by means of side slide die 42 that slides substantially radially in the circumferential direction of vane 41. In addition, because the outer periphery of impeller 34 is sheet-metal-made blade 37, the outer diameter and blade curvature can be arbitrarily set independent of a complex shape of resin-made inducer 39. In other words, in the present embodiment, resin-made inducer 39 reduces turbulence of the air flow near inlet hole 25, and sheet-metal-made blade 37 efficiently raises pressure in the outer periphery of impeller 34. Therefore, impeller 34 having high sucking performance is easily realized.

For smoothly directing the air flow from the shaft direction to the direction orthogonal to the shaft near inlet hole 25, the direction must be gradually changed in a long passage. Therefore, length of vane 41 of resin-made inducer 39 must be increased. While, for forming the side slide die in a shape moldable with simple side slide die 42, numbers of vanes 41 and of sheet-metal-made blades 37 must be reduced. FIG. 6 shows a relation between number of vanes of impeller 34 and efficiency. As is evident from FIG. 6, regarding an impeller which rotates at a high speed higher than 40000 r/min at 1.4 $m^3$/min and can have vacuum pressure higher than 20 kPa, efficiency indicating air performance decreases when the number of vanes is decreased to five, and high efficiency is obtained for six vanes. As a result, in the present embodiment, an optimal number of vanes of impeller 34 is six, and at this time the highest sucking performance is obtainable. In FIG. 6, the vertical axis shows difference of fan efficiency, and one point shows 1% difference.

The third embodiment of the present invention is described hereinafter with reference to FIGS. 7(*a*) and (*b*). A basic structure of an impeller is equivalent to that in embodiment 2, therefore, the same elements are denoted with the same reference numbers, and detail description is eliminated. A distinctive part in this embodiment is a molding process of a resin-made inducer, and is hereinafter described in detail.

Figure 7:
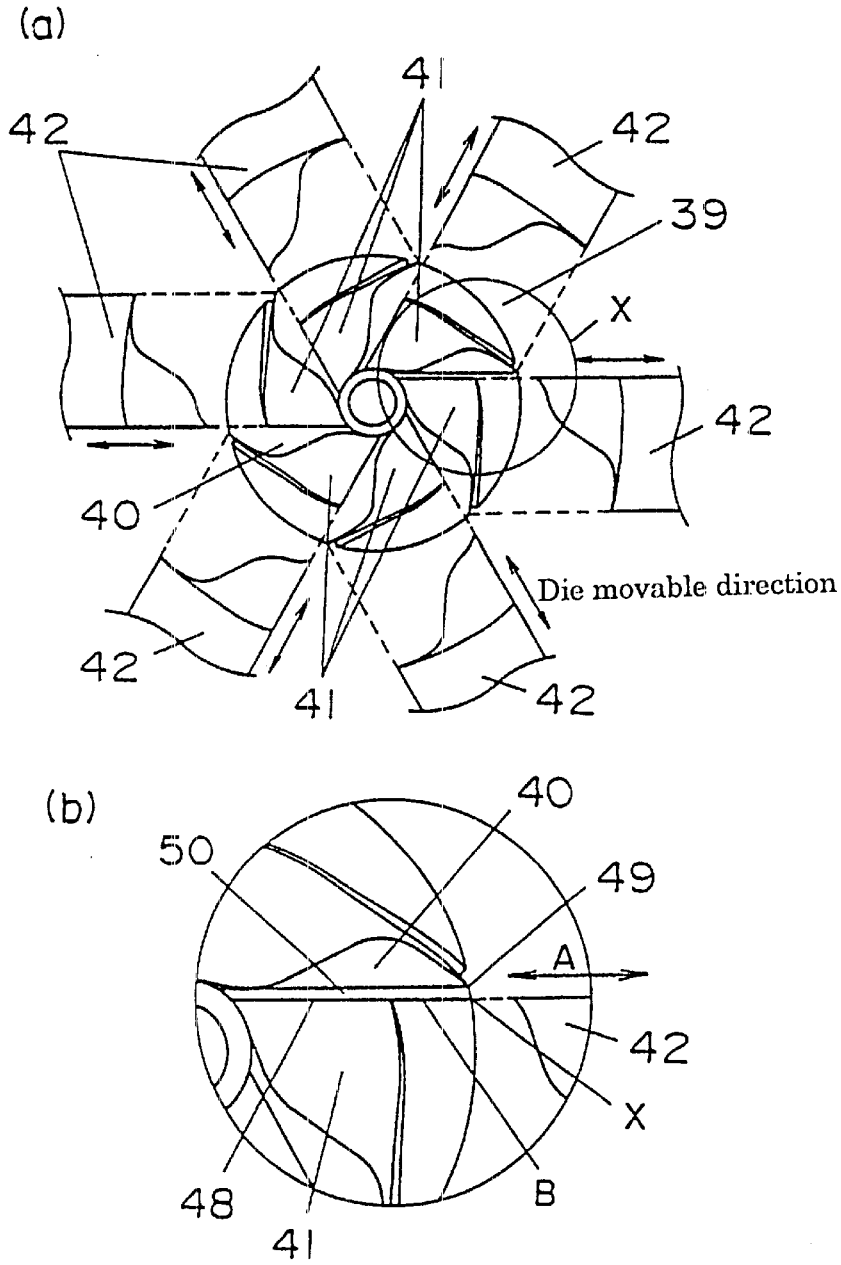
FIG. 7(*a*) is a plan view showing an operation of a die during molding of a resin-made inducer in an impeller of an electric blower in accordance with a third exemplary embodiment of the present invention.

FIG. 7(*a*) shows an operation of a die during molding of inducer 39, and FIG. 7(*b*) is a partially enlarged view of X part in FIG. 7(*a*).

In FIGS. 7(*a*) and (*b*), slide direction A of side slide die 42 is matched to that of line B for connecting inlet tip 48 of vane 41 with position X displaced from outer periphery end 49 by clearance 50. In other words, line B exists on an direct extension of linear tip 48 and matches to slide direction A. A parting line generated due to a relation with upper slide die 43 is generated on inlet tip 48. If clearance 50 is lost, side slide die 42 may interfere with outer periphery end 49 of the vane. Therefore, a clearance of about 1 mm is required in a die structure.

In the operation in the structure discussed above, impeller 34 rotates at a high speed, and air flow is sucked from inlet hole 25 of impeller 34. This air flow travels through an inner passage surrounded with front shroud 36 and resin-made inducer 39, then travels through an inner passage surrounded with rear and front shrouds 35,36 and sheet-metal-made blade 37, and goes out from the outer periphery of impeller 34. At this time, the air flow comes from inlet tip 48, and smoothly changes in direction along vane 41 from the shaft direction of impeller 34 to the direction orthogonal to the shaft to raise pressure in an adjacent passage.

Thus, in impeller for the electric blower according to the present embodiment, as shown in FIG. 4, impeller 34 is divided as resin-made inducer 39 and sheet-metal-made blade 37, and resin-made inducer 39 has a shape capable of being molded by means of side slide die 42 that slides substantially radially in the circumferential direction of vane 41. In addition, slide direction A of side slide die 42 is matched to that of line B for connecting inlet tip 48 of vane 41 with position X displaced from outer periphery end 49 by clearance 50. As a result, inducer 39 having a three-dimensional curved surface can be formed near inlet hole 25 without employing complex dies, the entire length of vane 41 expanding from inlet tip 48 can be ensured to be long, and air flow is changed gradually to reduce turbulence.

In addition, because the outer periphery of impeller 34 is sheet-metal-made blade 37, the outer diameter and blade curvature can be arbitrarily set independently of a complex shape of resin-made inducer 39. The turbulence of the air flow near inlet hole 25 can be easily reduced, the pressure can be efficiently increased in the outer periphery of impeller 34, and therefore, high sucking performance is obtainable.

Figure 8:
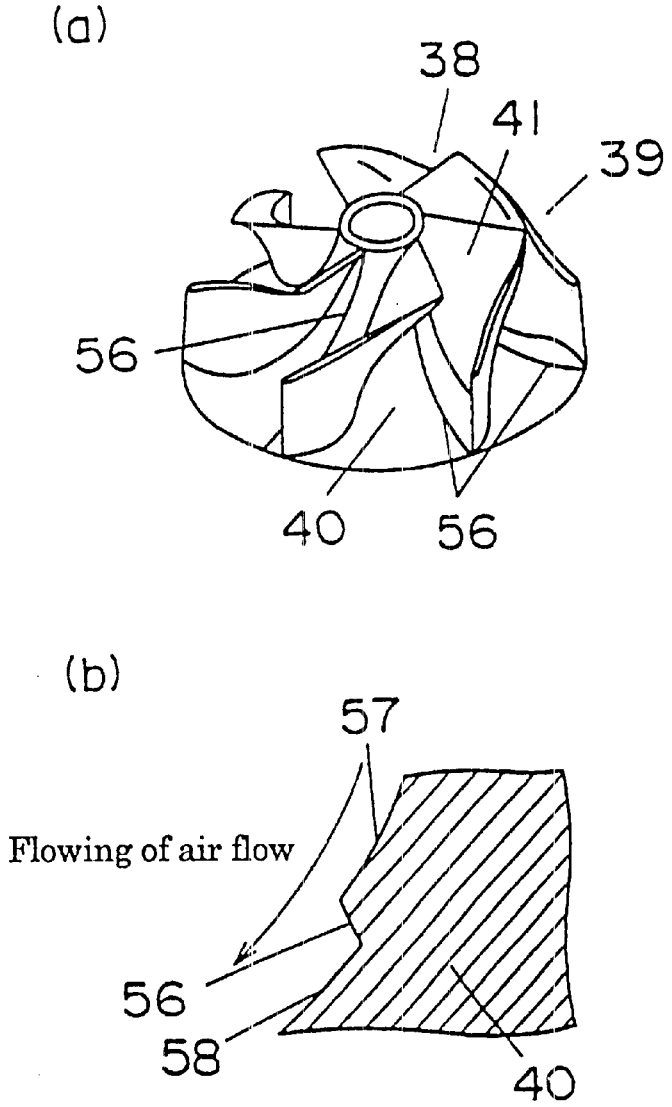
FIG. 8(*a*) is a perspective view of an impeller for an electric blower in accordance with a fourth exemplary embodiment of the present invention.

The fourth embodiment of the present invention is described hereinafter with reference to FIGS. 8(*a*) and (*b*) and FIGS. 9(*a*) and 9(*b*). A basic structure of an impeller is equivalent to that in embodiment 3, and therefore detailed description is eliminated. A distinctive part in this embodiment is an inducer, and is hereinafter described in detail. FIG. 8(*a*) is a perspective view of the inducer, FIG. 8(*b*) is an enlarged sectional view of a parting line portion on a hub, and FIGS. 9(*a*) and (*b*) show an operation of a die during molding of the inducer.

Figure 9:
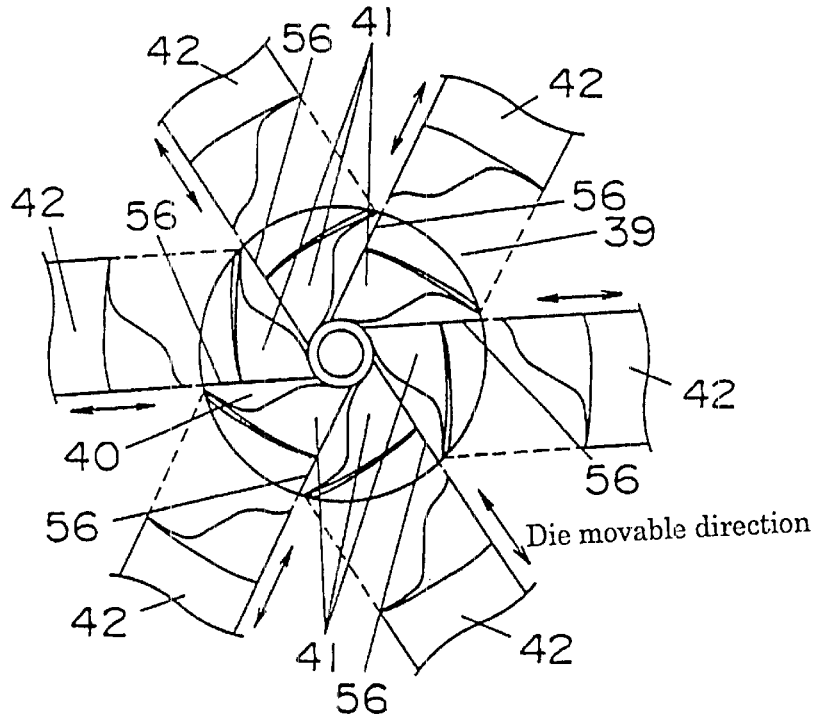
FIG. 9(*a*) is a plan view showing an operation of a die during molding of the same impeller in FIG. 8(*a*).
Figure 9:
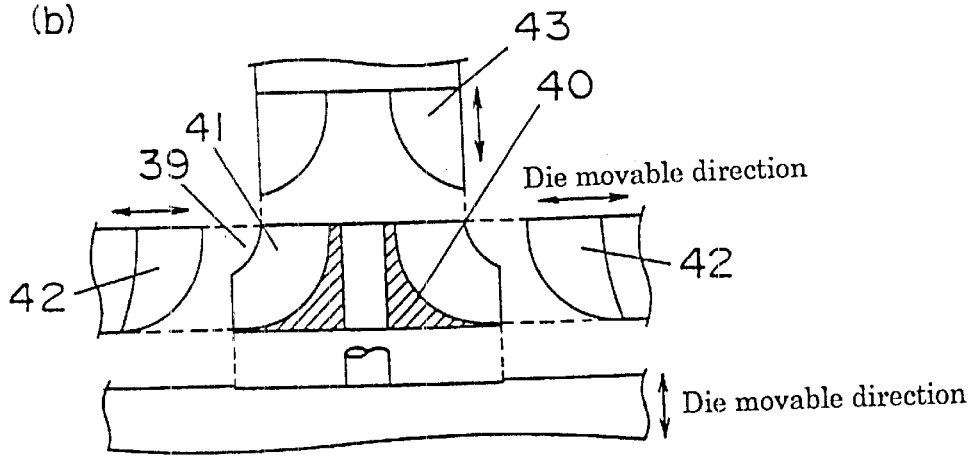

In FIGS. 8(*a*) and (*b*) and FIGS. 9(*a*) and (*b*), inducer 39 comprises substantially conical resin-made hub 40 and resin-made vane 41 formed on hub 40. For raising power of an electric blower, streamlining performance must be increased, and vane 41 has the shape of a three-dimensional curved surface. Parting line 56 formed during resin molding using a slide-type die exists on a surface of at least one of hub 40 and vane 41. Parting line 56 is a step occurring on a joint surface between a plurality of dies (side slide die 42 and upper slide die 43), and its downstream portion 58 side (mainly exhaust side) of air flow is set lower than upstream portion 57 side (mainly inlet hole side).

The operation in the structure discussed above is described. The route of air flow is same as that in embodiment 3 (FIG. 4), impeller 34 rotates at a high speed, and air flow is sucked from inlet hole 25 of impeller 34. This air flow travels through an inner passage surrounded with hub 40 and vane 41 having a three-dimensional curved shape, and goes out from the outer periphery of impeller 34. In the present embodiment (FIGS. 8(*a*) and (*b*)), when air flow travels through the step of parting line 56, internal air flow smoothly travels from higher upstream portion 57 to lower downstream portion 58.

Thus, since downstream portion 58 of air flow of the step of parting line 56 is set lower than upstream portion 57, in impeller 34 for the electric blower according to the present embodiment, collision of air flow does not occurs, air flow turbulence in the inner passage surrounded with hub 40 and vane 41 is reduced, and high sucking performance is obtainable.

Figure 10:
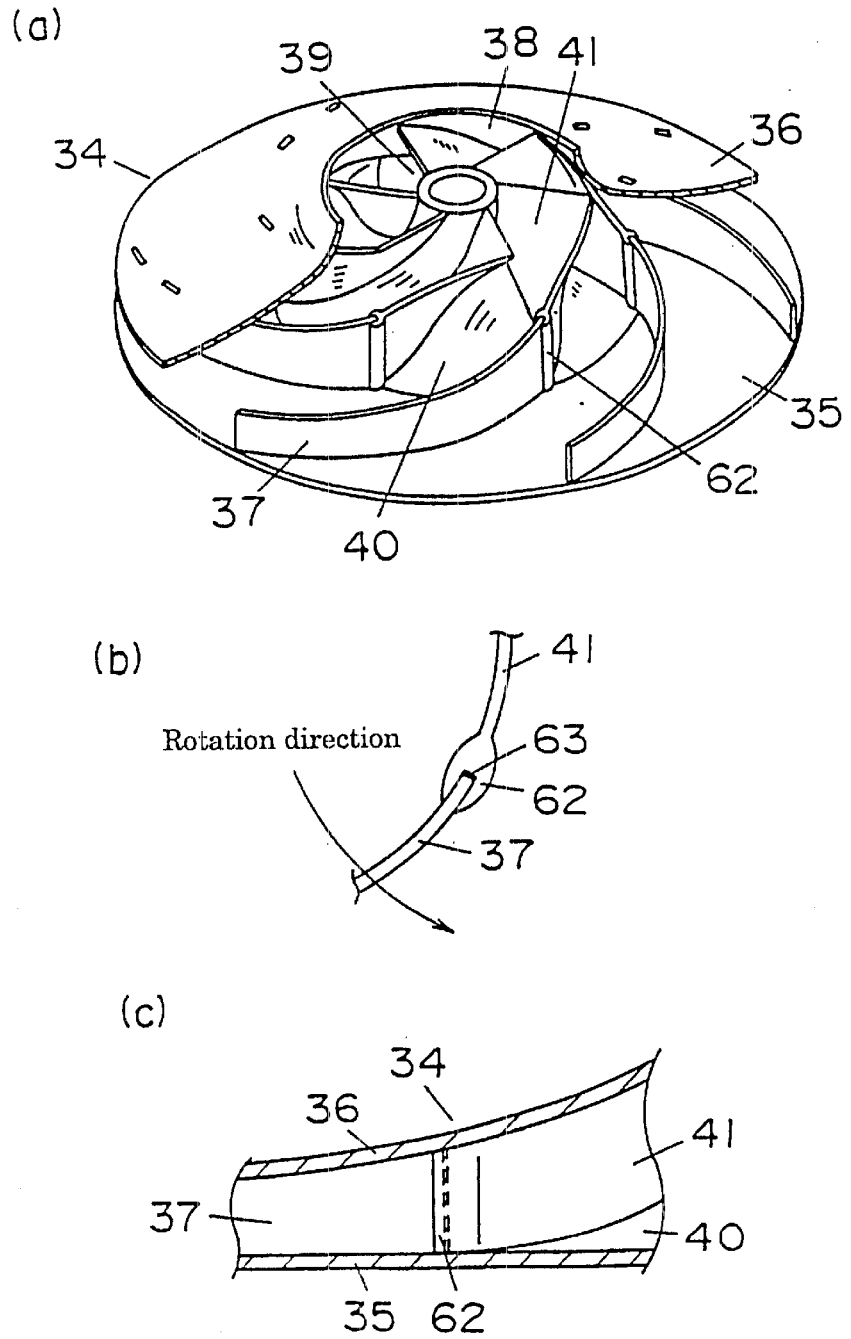
FIG. 10(*a*) is a partially-cut away perspective view of an impeller for an electric blower in accordance with a fifth exemplary embodiment of the present invention.

The fifth embodiment of the present invention is described hereinafter with reference to FIGS. 10(*a*)–(*c*). A mounting structure of an impeller and electric motor 6 is equivalent to that in the prior art, and therefore detail description is eliminated. A distinctive part in this embodiment is an impeller, and is hereinafter described in detail. FIG. 10(*a*) is a partially-cut away perspective view of an impeller, and FIG. 10(*b*) and FIG. 10(*c*) are enlarged plan views of a connecting part between a blade and an inducer.

In FIGS. 10(*a*)–(*c*), impeller 34 comprises the following elements: sheet-metal-made rear shroud 35; sheet-metal-made front shroud 36 placed away from rear shroud 35; a plurality of sheet-metal-made blades 37 that are grabbed between a pair of shrouds 35, 36; and resin-made inducer 39 corresponding to inlet hole 38 drilled in the center of front shroud 36.

Mounting of sheet-metal-made blades 37 to each of shroud 35, 36 is performed by crimp machining similar to the conventional structure. Resin-made inducer 39 comprises substantially conical hub 40 and vane 41 formed on hub 40. Vane 41 has the shape having a three-dimensional curved surface, especially in order to streamline air that flows from inlet hole 25 to sheet-metal-made blade 37 side. When such complex-shaped inducer 39 is manufactured, preferably, resin molding is employed.

Connecting portion 62 is disposed on resin-made inducer 39, and groove 63 which engages with an inlet hole 38 side end of sheet-metal-made blades 37 is formed in connecting portion 62. As is evident from FIGS. 10(*a*)–(*c*), groove 63 has a shape so as to support both side surfaces of the inlet hole 38 side end of sheet-metal-made blades 37, and increases contact area between resin-made inducer 39 and sheet-metal-made blades 37.

In the operation in the structure discussed above, impeller 34 rotates at a high speed, and air flow is sucked from inlet hole 38 of impeller 34. This air flow travels through an inner passage surrounded with front shroud 36 and resin-made inducer 39, then travels through an inner passage surrounded with rear and front shrouds 35, 36 and sheet-metal-made blades 37, and goes out from the outer periphery of impeller 34. At this time, the internal air flow smoothly travels without leakage to an adjacent passage because resin-made inducer 39 is connected to sheet-metal-made blades 37 through connecting portion 62 without clearance.

Figure 11:
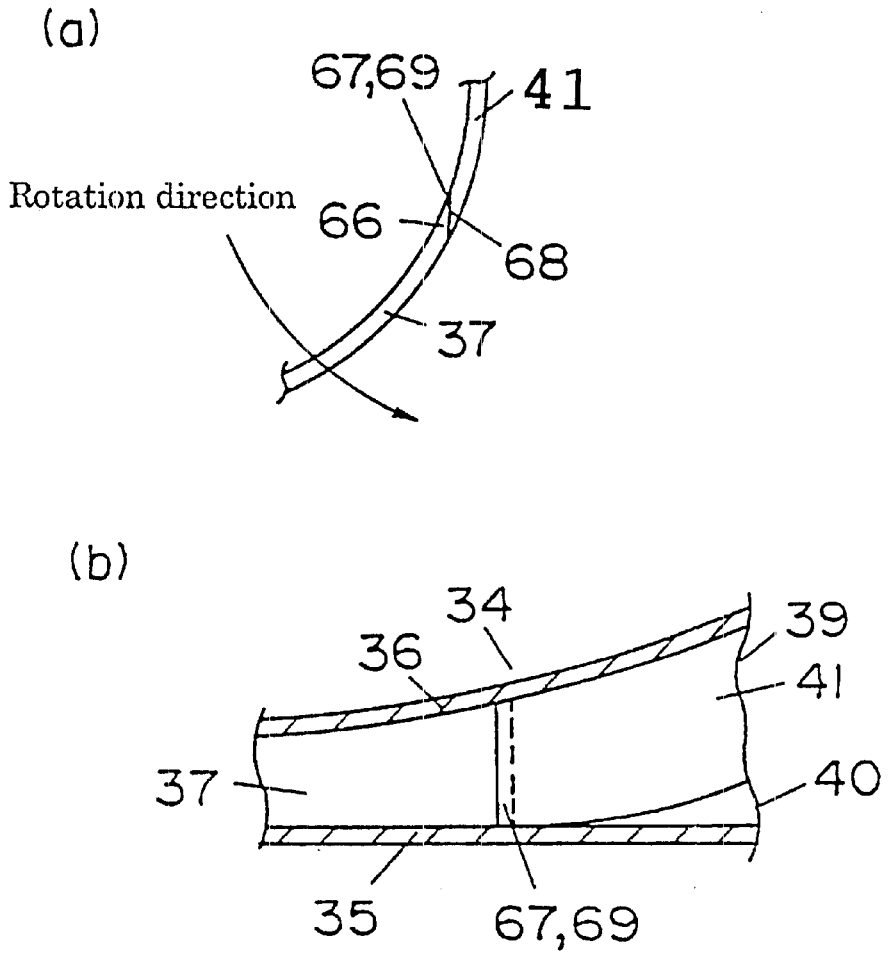
FIG. 11(*a*) is an enlarged plan view of a connecting part between a blade and an inducer in an impeller for an electric blower in accordance with another exemplary embodiment of the fifth embodiment of the present invention.

FIGS. 11(*a*) and (*b*) shows another embodiment. Tilting surface 67 is formed on an inlet-hole side end 66 of sheet-metal-made blade 37, and connecting portion 68 of resin-made inducer 39 is a tilting surface abutting to tilting surface 67 of sheet-metal-made blade 37. Thickness of an end of sheet-metal-made blades 37 is equal to that of connecting portion 68 of resin-made inducer 39. Therefore, the outline of the connecting portion has a smooth plane shape as shown in FIGS. 11(*a*) and (*b*), air flowing in this portion is prevented from being disturbed, and turbulence of air flow can be further reduced. Since both tilting surfaces abut to each other in relation to a surface, air tightness can be ensured, air hardly leaks to the adjacent passage, collision or separation of air flow is reduced, and internal air smoothly flows.

The sixth embodiment of the present invention is described hereinafter with reference to FIGS. 12(*a*)–(*c*). A basic structure of impeller 34 is equivalent to that in embodiment 1 discussed above, therefore, the same elements are denoted with the same reference numbers, and detailed description is eliminated. A distinctive part in this embodiment is a connecting part of sheet-metal-made blade 37 with resin-made inducer 39, and is hereinafter described in detail.

Figure 12:
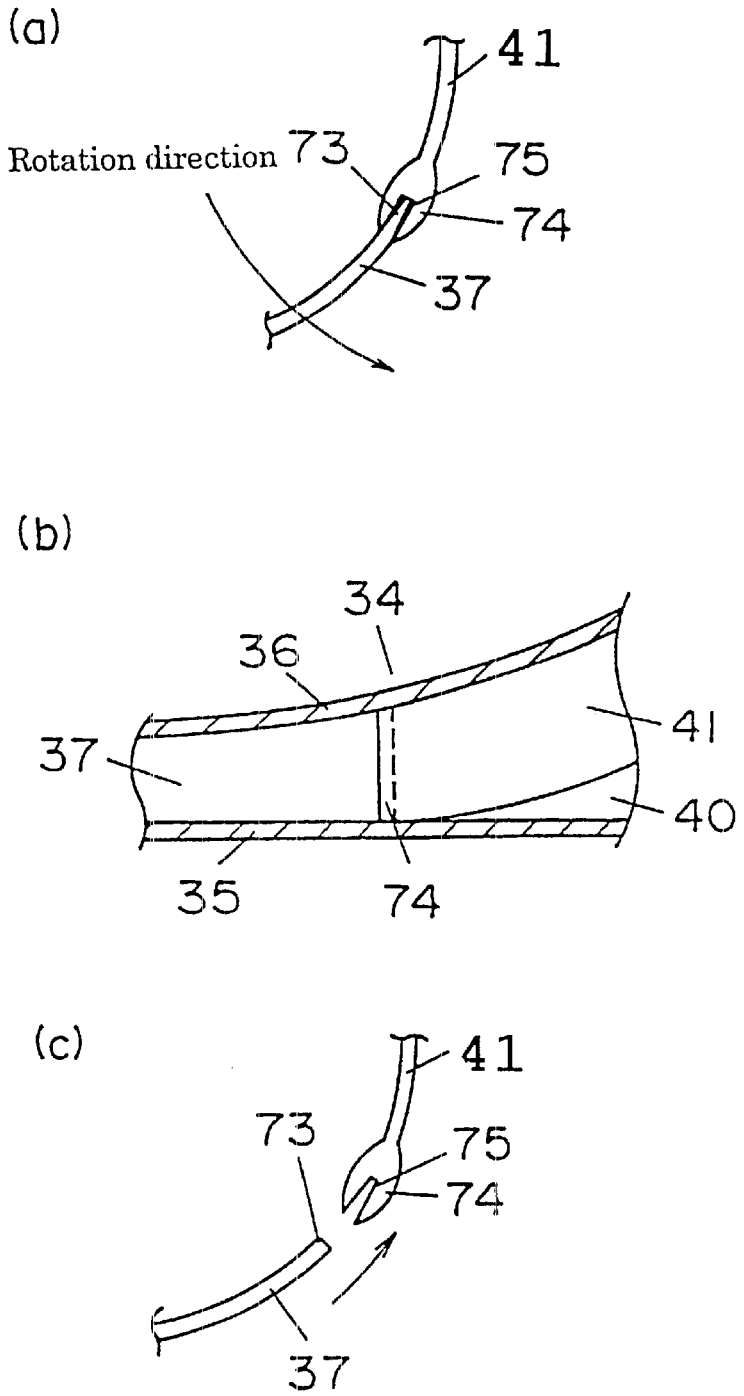
FIG. 12(*a*) is an enlarged plan view of a connecting part between a blade and an inducer in an impeller for an electric blower in accordance with a sixth exemplary embodiment of the present invention.

FIG. 12(*a*) and FIG. 12(*b*) are enlarged views of a connecting part between blade 37 and inducer 39 in impeller 34.

In FIGS. 12(*a*)–(*c*), inlet-hole-side end 73 of sheet-metal-made blade 37 is pressed into tapered groove 75 of connecting portion 74. In other words, before inlet-hole-side end 73 of sheet-metal-made blade 37 is inserted, groove 75 of connecting portion 74 is tapered as shown in FIG. 12(*c*). After inlet-hole-side end 73 of sheet-metal-made blade 37 is inserted into groove 75, it is held in groove 75 as shown in FIG. 12(*a*).

Since both sides of inlet-hole-side end 73 of sheet-metal-made blade 37 are grabbed by connecting portion 74, the connecting portion can certainly receive a force of inlet-hole-side end 73 of sheet-metal-made blade 37 even when impeller 34 rotates. In particular, when rotation of impeller 34 is rapidly decelerated, namely when a rapid deceleration is caused not by overload of impeller 34 caused by abnormality of a bearing or the like of electric motor 6, but overload of electric motor 6 itself, inlet-hole-side end 73 of sheet-metal-made blade 37 tends to move in the direction opposite to a normal rotation. However, end 73 can certainly receive such force because it is sandwiched by connecting portion 74 from both sides, and positional displacement does not occur between resin-made inducer 39 and sheet-metal-made blade 37.

The seventh embodiment of the present invention is described hereinafter with reference to FIGS. 13 (*a*) and (*b*). A basic structure of impeller 34 is equivalent to that in the embodiment discussed above, therefore, the same elements are denoted with the same reference numbers, and detailed description is eliminated. A distinctive part in this embodiment is a connecting part of sheet-metal-made blade 37 with resin-made inducer 39, and is hereinafter described in detail.

Figure 13:
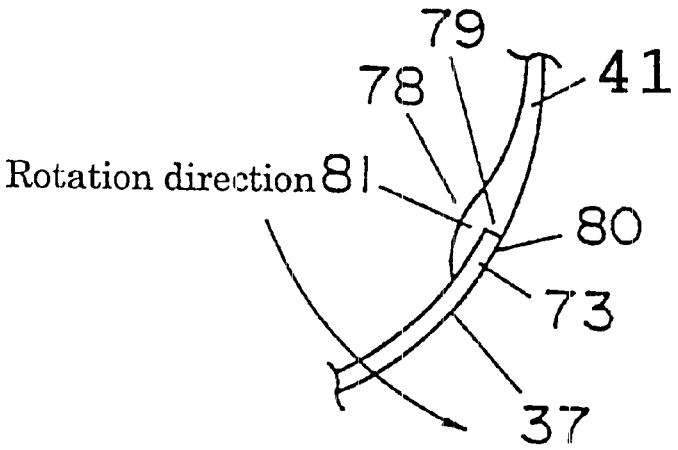
FIG. 13(*a*) is an enlarged plan view of a connecting part between a blade and an inducer in an impeller for an electric blower in accordance with a seventh exemplary embodiment of the present invention.
Figure 13:
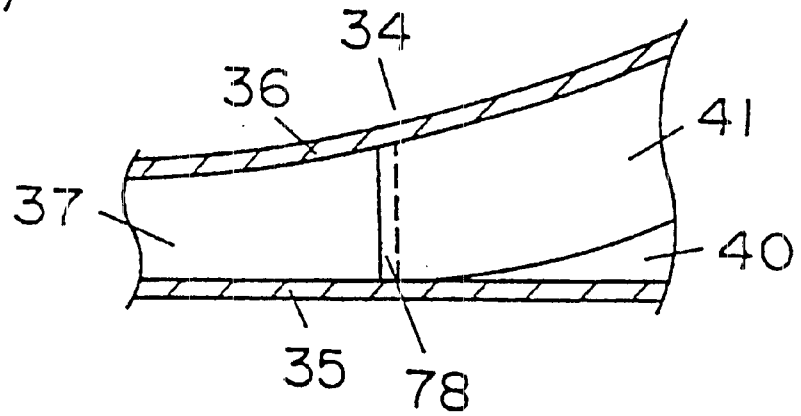

FIG. 13(*a*) and FIG. 13(*b*) are enlarged views of a connecting part between blade 37 and inducer 39 in impeller 34.

In FIGS. 13(*a*) and (*b*), connecting portion 78 of resin-made inducer 39 has step portion 79 abutting to one side of inlet-hole-side end 73 of sheet-metal-made blade 37, and the abutting direction is set to be the pressure contact direction of end 73 of sheet-metal-made blade 37 due to rotation of the impeller. Because end 73 of sheet-metal-made blade 37 is engaged with step portion 79 of connecting portion 78, the other surface 80 of end 73 of sheet-metal-made blade 37 and the outer peripheral surface of connecting portion 78 become flat without gap. In addition, the inner peripheral surface 81 side of connecting portion 78 is formed in a circular arc shape and thickened, and enough strength to receive a force of end 73 of sheet-metal-made blade 37 is obtainable.

In this structure, when impeller 34 rotates, one surface of inlet-hole-side end 73 of sheet-metal-made blade 37 is pressed onto connecting portion 78. Therefore, air-tightness between sheet-metal-made blade 37 and inducer 39 is improved to prevent air from leaking. Especially, even when sheet-metal-made blade 37 does not precisely abut to connecting portion 78 during start of the rotation of impeller 34, a rotating force transfers through connecting portion 78 and sheet-metal-made blade 37 in this order, and therefore, pressure contact between both is finished as soon as it rotates. In addition, since inner peripheral surface 81 of connecting portion 78 is circular arc shaped, air traveling through this portion is prevented from being largely disturbed and reduction of efficiency can be restrained. Since the outer peripheral surface of connecting portion 78 and sheet-metal-made blade 37 are formed flat without gap, air flow on this side is hardly disturbed. Furthermore, sheet-metal-made blade 37 is not required to be inserted into resin-made inducer 39 to facilitate assembling of components.

The eighth embodiment of the present invention is described hereinafter with reference to FIGS. 14(*a*) and (*b*). A basic structure of impeller 34 is equivalent to that in the embodiment discussed above, therefore, the same elements are denoted with the same reference numbers, and detail description is eliminated. A distinctive part in this embodiment is a connecting part of sheet-metal-made blade 37 with resin-made inducer 39, and is hereinafter described in detail.

Figure 14:
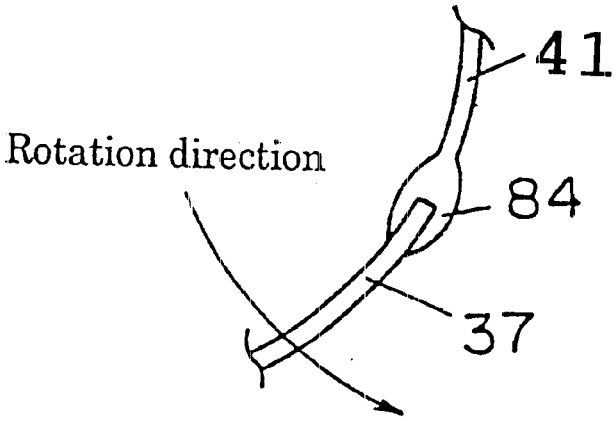
FIG. 14(*a*) is an enlarged plan view of a connecting part between a blade and an inducer in an impeller for an electric blower in accordance with an eighth exemplary embodiment of the present invention.
Figure 14:
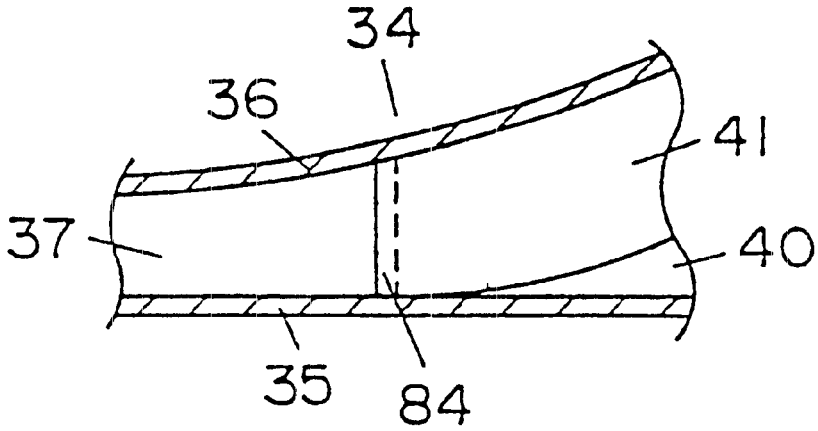

FIG. 14(*a*) and FIG. 14(*b*) are enlarged views of a connecting part between blade 37 and inducer 39 in an impeller.

In FIGS. 14(*a*) and (*b*), sheet-metal-made blade 37 is connected with connecting portion 84 placed at the outer edge of resin-made inducer 39. Resin-made inducer 39 and an end of sheet-metal-made blade 37 are integrally molded with each other without clearance using connecting portion 84 in an integral molding process.

Thus, in the impeller for the electric blower according to the present embodiment, since the end of sheet-metal-made blade 37 and connecting portion 84 of resin-made inducer 39 are integrally molded with each other, assembling is facilitated, clearance does not occur, and positional displacement during rotation does not occur either.

The ninth embodiment of the present invention is described hereinafter with reference to FIG. 15 to FIG. 17. The same elements as those in the embodiment discussed above are denoted with the same reference numbers, and description on them is eliminated.

Figure 15:
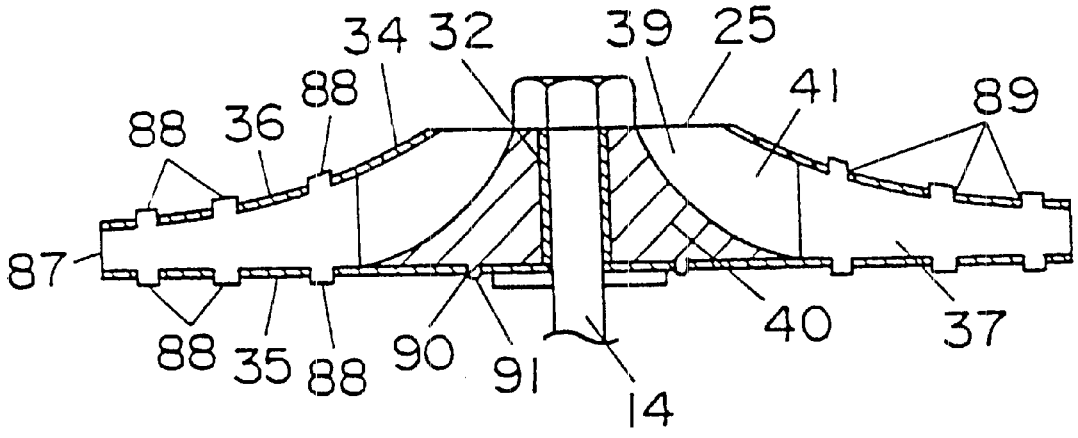
FIG. 15 is a sectional view of an impeller for an electric blower in accordance with a ninth exemplary embodiment of the present invention.
Figure 16:
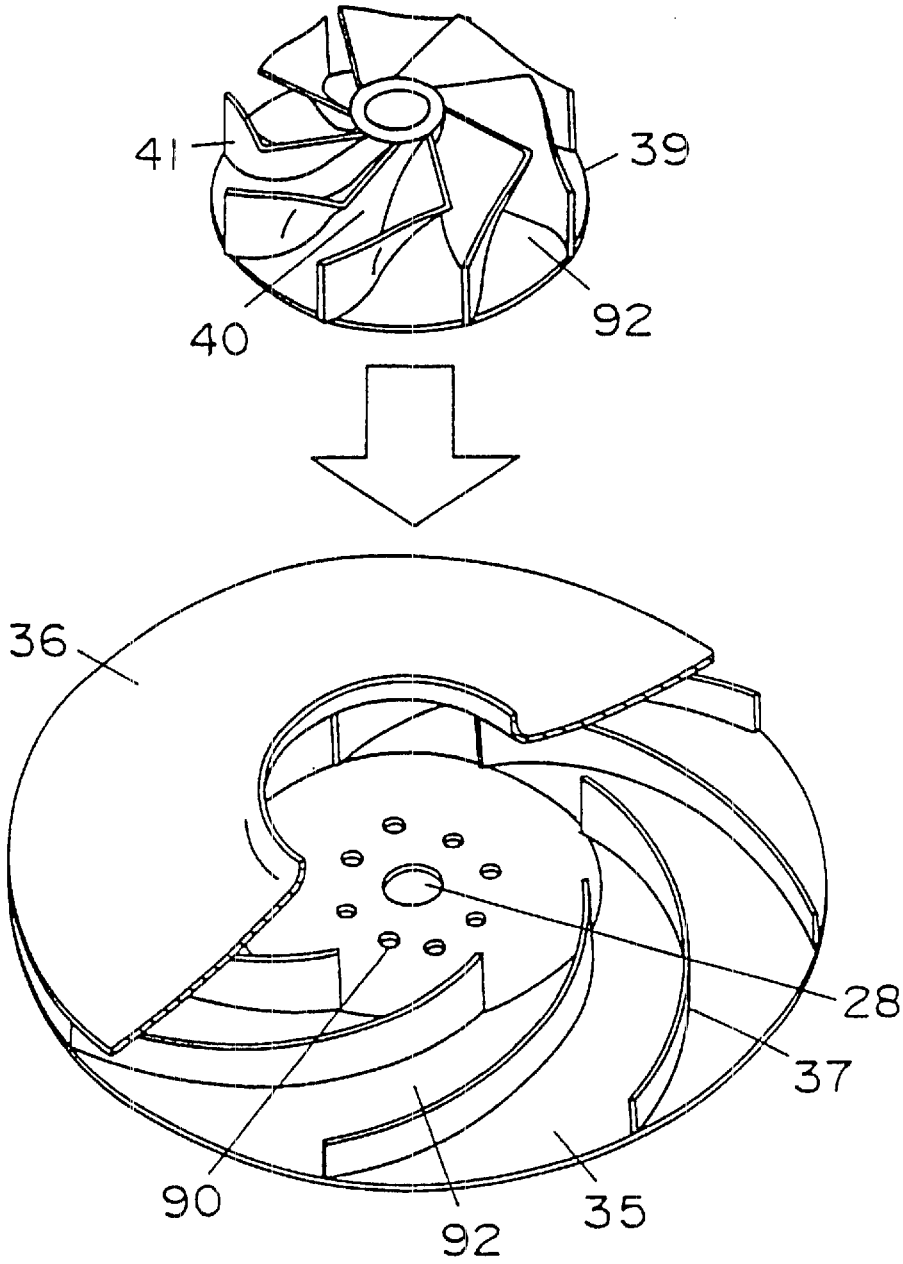
FIG. 16 is a partially-cut away perspective view showing assembling of the same impeller in FIG. 15.

FIG. 15 is a sectional view of impeller 34, and FIG. 16 is a partially-cutaway perspective view of impeller 34.

In FIG. 15, a plurality of sheet-metal-made blades 37 are placed in a pair of shrouds, namely sheet-metal-made rear shroud 35 and sheet-metal-made front shroud 36. Resin-made inducer 39 comprises hub 40 and vane 41 that is integrally formed on hub 40 and has a three-dimensional curved surface positioned on the extension of sheet-metal-made blades 37. A plurality of engaging portions 88 are formed on sheet-metal-made blades 37. Engaged portions 89 facing engaging portions 88 are formed in front shroud 36 and rear shroud 35.

A shaft hole 28 (FIG. 16) fixed to rotating shaft 14 of an electric motor is drilled in the center of rear shroud 35, and cylindrical sleeve 32 engaging with rotating shaft 14 is inserted into hub 40 in the center of inducer 39.

A plurality of engaging bosses 91 that are inserted into a plurality of holes 90 formed in rear shroud 35 are disposed on a surface abutting to rear shroud 35 of hub 40. Number of bosses 91 and number of holes 90 are respectively set equal to a divisor of number of vanes 41 of inducer 39 and number of blades 37.

For assembling impeller 34, engaging portion 88 formed on blade 37 is engaged with engaged portion 89 in rear shroud 35 for temporary assembling, and then inducer 39 is mounted while engaging boss 91 formed on hub 40 is engaged with hole 90 drilled in rear shroud 35. Next, temporarily-assembled engaged portion 89 formed in front shroud 36 from upside is engaged with engaging portion 88 on blade 37 for assembling. Finally, engaging portion 88 is crimped and fixed.

Figure 17:
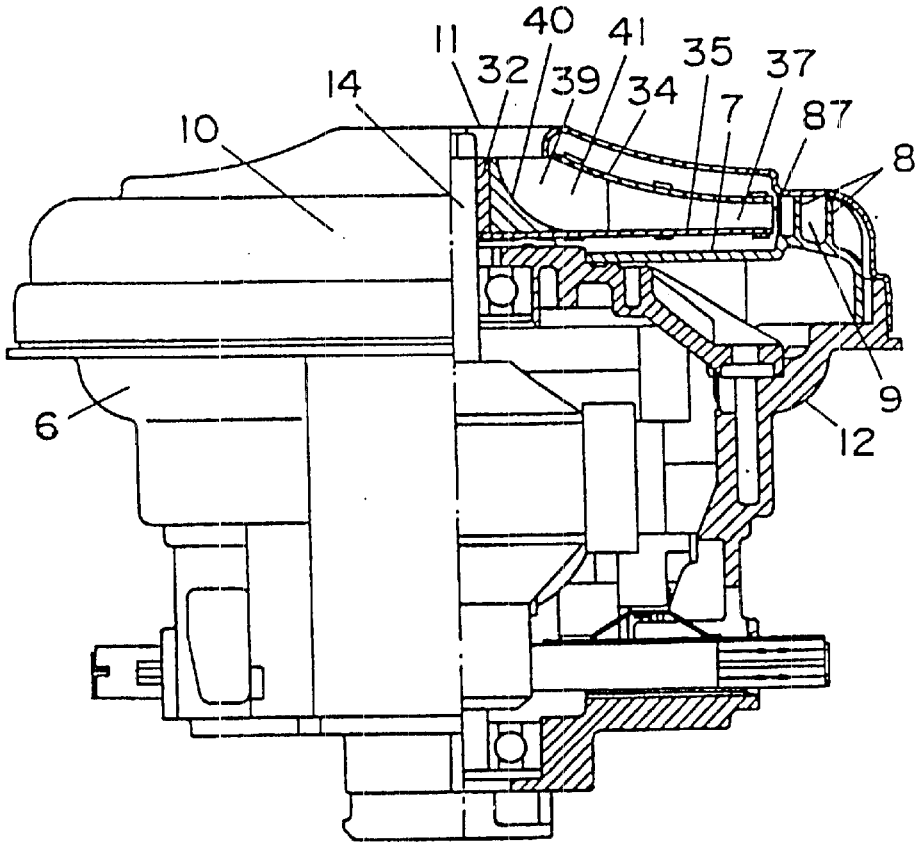
FIG. 17 is a partially-cut away side view of an electric blower including the same impeller in FIG. 15.

In FIG. 17, a plurality of exhaust openings 87 surrounded with adjacent blade 37, front shroud 36, and rear shroud 35 are formed on the outer periphery of impeller 34, air guide 7 having a plurality of stationary blades 8 facing exhaust openings 87 with a micro clearance is placed on the outer periphery of exhaust openings 87, and volute chamber 9 is formed between adjacent stationary blades 8.

Fan case 10 contains impeller 34 and air guide 7, is air-tightly mounted to the outer periphery of electric motor 6, and has intake opening 11 in the central part. Inlet hole 25 of front shroud 36 is disposed facing intake opening 11.

An operation in the structure discussed above is described hereinafter.

When impeller 34 fixed to rotating shaft 14 of electric motor 6 rotates at a high speed (40000 r/min), air flow is sucked from inlet hole 25 of impeller 34 communicating with intake opening 11 of fan case 10. This air flow travels through inner passage 92 surrounded with front shroud 36, vane 41 formed on resin-made inducer 39, and hub 40, then travels through inner passage 92 surrounded with front shroud 36, rear shroud 35, and sheet-metal-made blade 37, and goes out from exhaust opening 87 in the outer periphery of impeller 34. The air exhausted from impeller 34 is guided into volute chamber 9 defined with adjacent stationary blades 8 formed on air guide 7 and fan case 10, and is exhausted from the lower surface of air guide 7 into electric motor 6.

When the impeller is assembled, resin-made inducer 39 is accurately positioned with a plurality of engaging bosses 91 formed on the bottom surface of hub 40 so that the inducer has a given relative relation with rear shroud 35. Therefore, clearance of a joint portion between vane 41 of resin-made inducer 39 and sheet-metal-made blade 37 can be minimized. As a result, the air flow can provide high sucking performance because the air flow hardly leaks to an adjacent passage, pressure reduction or turbulence of air flow in inner passage 92 after the joint portion is prevented, and pressure rising and flowing of internal air are smoothly performed.

Number of each of engaging bosses 91 and holes 90 is set equal to a divisor of number of vanes 41 of inducer 39 or blades 37. Therefore, even when inducer 39 is mounted to rear shroud 35 at any angle, positions of vanes 41 and blades 37 match to each other, and assembling ability of inducer 39 can be improved.

Engaging boss 91 engaging with hole 90 of rear shroud 35 is placed on hub 40 in order to position inducer 39 in the present invention. However, it is clear that a projecting part may be formed on rear shroud 35 and a recessed part engaging with the projecting part may be formed on the hub 40 side.

The tenth embodiment of the present invention is described hereinafter with reference to FIG. 18. The same elements as those in the embodiment discussed above are denoted with the same reference numbers, and description on them is eliminated.

Figure 18:
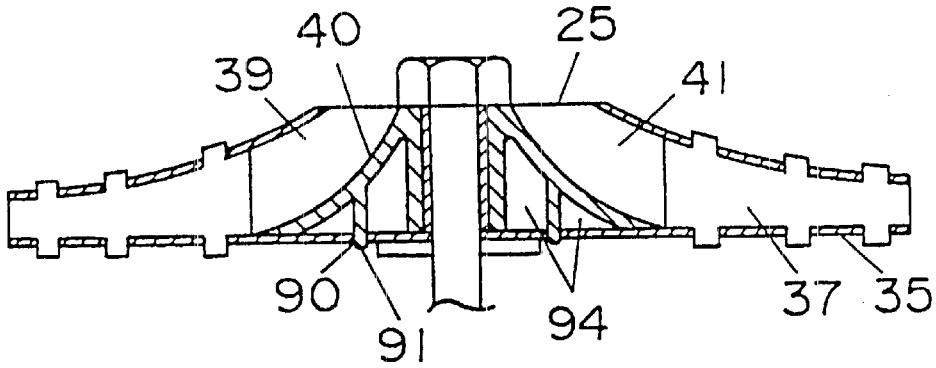
FIG. 18 is a sectional view of an impeller for an electric blower in accordance with a tenth exemplary embodiment of the present invention.

In FIG. 18, space portion 94 is placed on rear shroud 35 side of hub 40 constituting inducer 39 so that thickness of hub 40 is substantially uniform.

An operation in this structure is described hereinafter.

Since thickness of hub 40 is uniform, strain of resin during molding of inducer 39 is prevented from deforming it, and the inducer high in size accuracy can be realized. Therefore, clearance of a joint portion between vane 41 and blade 37 can also be minimized, and air leakage is prevented to realize an impeller high in sucking performance. The other operations are same as those in the embodiment discussed above.

Figure 19:
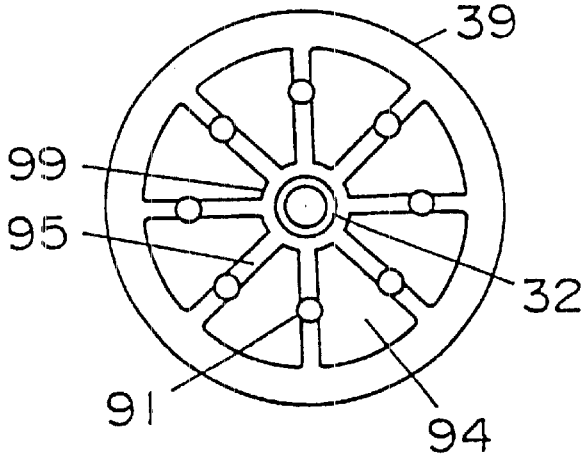
FIG. 19 is a bottom view of an inducer for an electric blower in accordance with an eleventh exemplary embodiment of the present invention.

The eleventh embodiment of the present invention is described hereinafter with reference to FIG. 19. The same elements as those in the embodiment discussed above are denoted with the same reference numbers, and description on them is eliminated.

Boss portion 99 having cylindrical sleeve 32 fixable to rotating shaft 14 is placed in the center of space portion 94 formed in hub 40 of inducer 39, a plurality of ribs 95 are arranged radially in space portion 94 so as to connect with boss portion 99, and engaging boss 91 capable of being inserted into hole 90 formed in rear shroud 35 (FIG. 18) is formed on rib 95.

An operation in this structure is described hereinafter.

Since ribs 95 are arranged radially in space portion 94 formed in hub 40 of inducer 39 and the engaging boss is placed, strength of inducer 39 is increased and inducer 39 can be certainly positioned and fixed. As a result, centrifugal force or torsion during high speed rotation of impeller 34 can be prevented from causing deformation or breakage of vane 41, and inducer 39 high in reliability can be realized. The other operations are same as those in the embodiment discussed above.

The twelfth embodiment of the present invention is described hereinafter with reference to FIG. 20. The same elements as those in the embodiment discussed above are denoted with the same reference numbers, and description on them is eliminated.

Figure 20:
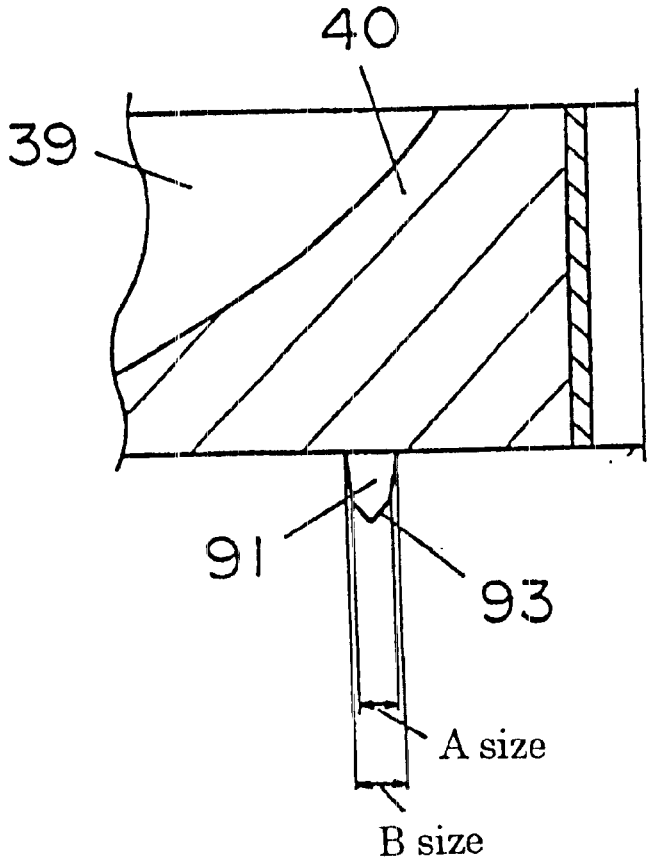
FIG. 20 is a sectional view of an important part of an inducer for an electric blower in accordance with a twelfth exemplary embodiment of the present invention.

FIG. 20 is an enlarged view of engaging boss 91 placed on the bottom surface of hub 40 of inducer 39.

Tilting portion 93 is placed at the tip of engaging boss 91. An outer diameter of a root portion (A size) of tilting portion 93 is smaller than an inner diameter of hole 90 formed in rear shroud 35, and an outer diameter of a root portion (B size) of engaging boss 91 is larger than the inner diameter of hole 90.

An operation in this structure is described hereinafter.

Since tilting portion 93 is placed at the tip of engaging boss 91 and the outer diameter of the tip of engaging boss 91 is smaller than the inner diameter of hole 90, engaging boss 91 can be easily inserted into hole 90 formed in rear shroud 35 when inducer 39 is mounted by inserting engaging boss 91 into hole 90. When the insertion is finished, the root portion of engaging boss 91 is pressed into hole 90 and tightly fixed. Therefore, assembling ability can be further improved and precise positioning and fixing can be performed.

The thirteenth embodiment of the present invention is described hereinafter with reference to FIG. 21. The same elements as those in the embodiment discussed above are denoted with the same reference numbers, and description on them is eliminated.

Figure 21:
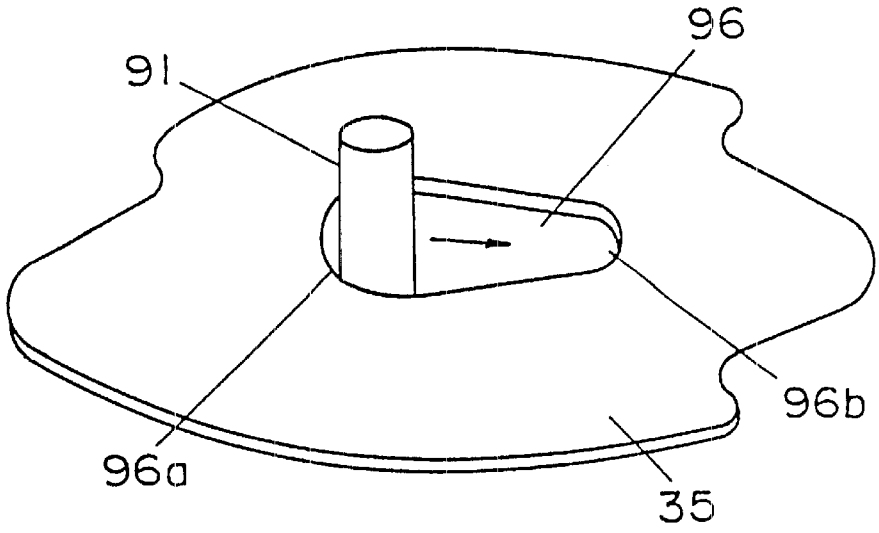
FIG. 21 is a perspective view showing a shape of a hole in a rear shroud for an electric blower in accordance with a thirteenth exemplary embodiment of the present invention.

FIG. 21 is an enlarged view of long hole 96 formed in rear shroud 35.

A plurality of long holes 96 are drilled in rear shroud 35, a diameter of maximum-diameter-portion 96*a* on one side of hole 96 is larger than that of engaging boss 91 disposed on hub 40, and a diameter of minimum-diameter-portion 96*b* on the other side of hole 96 is smaller than that of engaging boss 91.

An operation in this structure is described hereinafter.

Engaging boss 91 is pressed in minimum diameter portion 96*b* by inserting engaging boss 91 formed on hub 40 into maximum diameter portion 96*a* and then rotating inducer 39 to the minimum diameter portion 96*b* side. Assembling ability is further improved. During pressing-in, the outer peripheral end of vane 41 of inducer 39 must be matched to the end of blade 37. The other operations are same as those in the embodiment discussed above.

The fourteenth embodiment of the present invention is described hereinafter with reference to FIG. 22, FIG. 23(*a*), and FIG. 23(*b*). The same elements as those in the embodiment discussed above are denoted with the same reference numbers, and description on them is eliminated.

Figure 22:
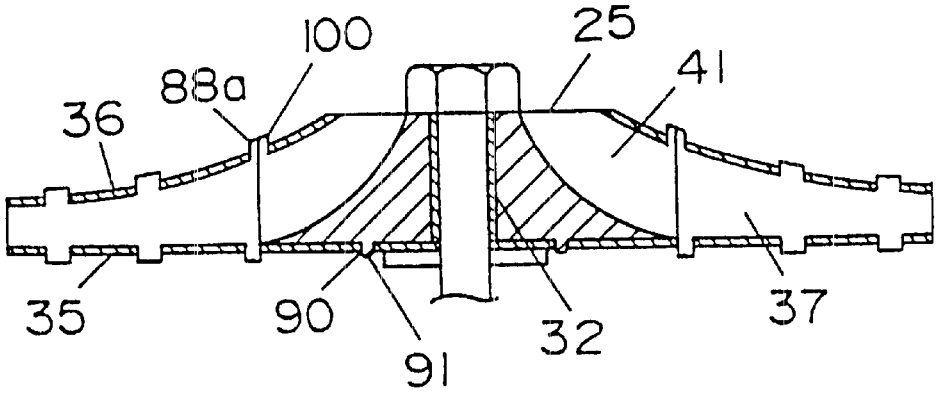
FIG. 22 is a sectional view of an impeller for an electric blower in accordance with a fourteenth exemplary embodiment of the present invention.
Figure 23:
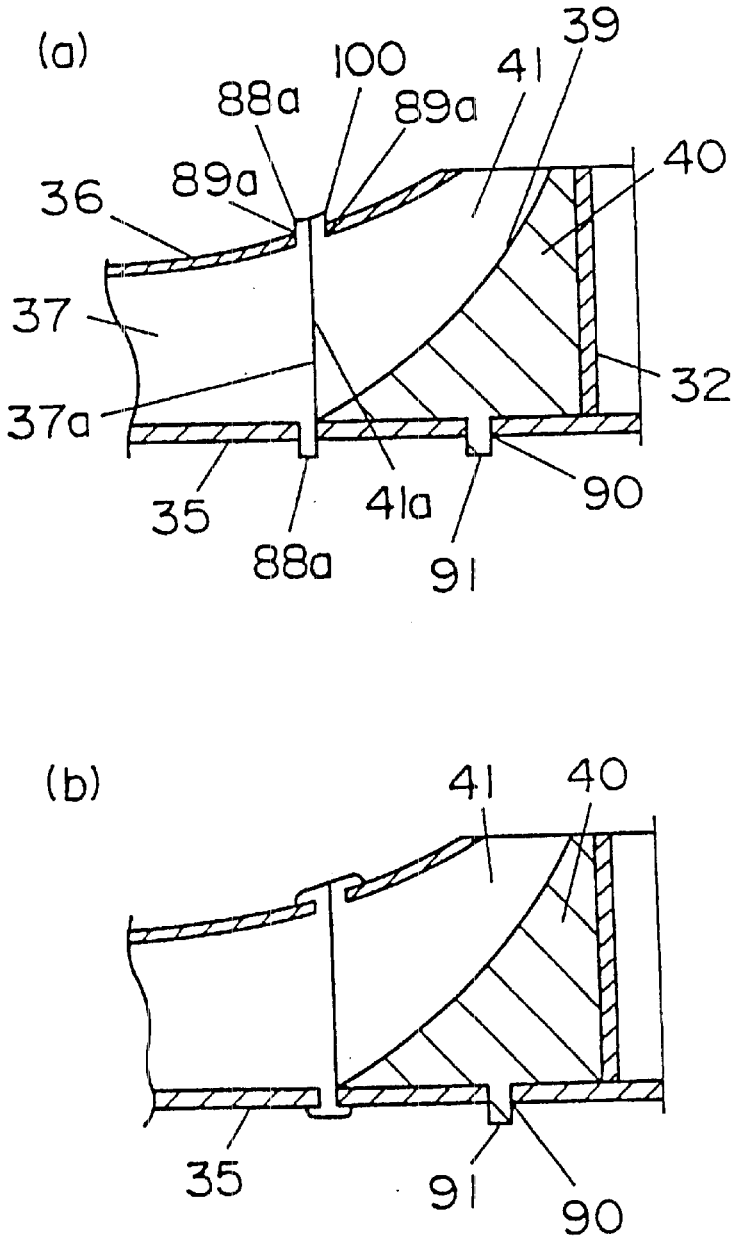
FIG. 23(*a*) is an enlarged sectional view of an important part (before crimping) of the same impeller in FIG. 22.

FIG. 22 is a sectional view of impeller 34, FIG. 23(*a*) is an enlarged view of projection 100 before crimping, and FIG. 23((*b*) is an enlarged sectional view of projection 100 after crimping.

Projection 100 placed on rear edge 41*a* of vane 41 of inducer 39 and engaging portion 88*a* on the inner side that is formed at front edge 37*a* of blade 37 are fixed to front shroud 36, by inserting them into a same engaged portion 89*a*, and simultaneously heating and crimping them as shown in FIG. 23(*b*).

An operation in this structure is described hereinafter.

Since projection 100 placed on rear edge 41 a of vane 41 of inducer 39 and engaging portion 88*a* formed at front edge 37*a* of blade 37 are inserted into the same engaged portion 89*a* formed in front shroud 36, inducer 39 and blade 37 are certainly positioned. The rear shroud 35 side can be similar to this. The other operations are similar to the embodiment discussed above.

The fifteenth embodiment of the present invention is described hereinafter with reference to FIG. 24. The same elements as those in the embodiment discussed above are denoted with the same reference numbers, and description on them is eliminated.

Figure 24:
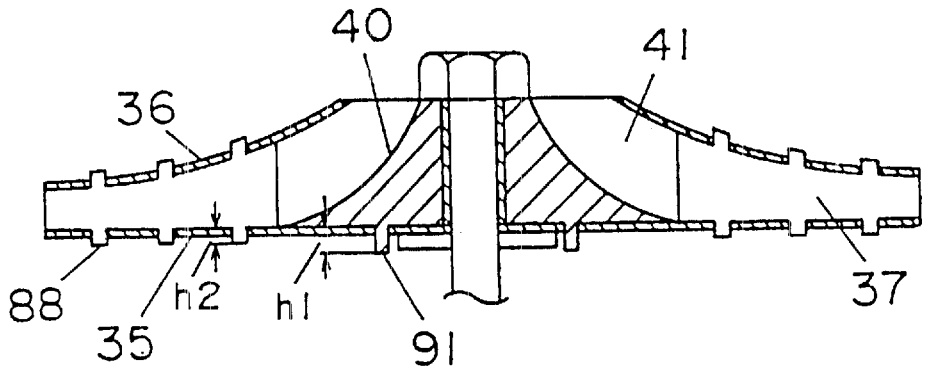
FIG. 24 is a sectional view of an impeller for an electric blower in accordance with a fifteenth exemplary embodiment of the present invention.

FIG. 24 is a sectional view of impeller 34. Height (h1) of engaging boss 91 formed on hub 40 of inducer 39 is higher than height (h2) of engaging portion 88 formed blade 37.

An operation in this structure is described hereinafter.

For assembling impeller 34, inducer 39 and blade 37 are temporarily assembled to front shroud 36 and then rear shroud 35 is mounted thereon. At this time, a position of rear shroud 35 is easily determined by engaging a plurality of engaging bosses 91 placed on hub 40 of inducer 39 with a plurality of holes 90 formed in rear shroud 35. Therefore, many engaging portions 88 automatically formed on blade 37 match and face to positions of a plurality of engaged portions 89 formed in rear shroud 35. Because number of engaging bosses 91 is much smaller than that of engaging portions 88, the temporary assembling of rear shroud 35 can be easily performed to greatly facilitate the assembling of impeller 34. The other operations are similar to the embodiment discussed above.

Figure 25:
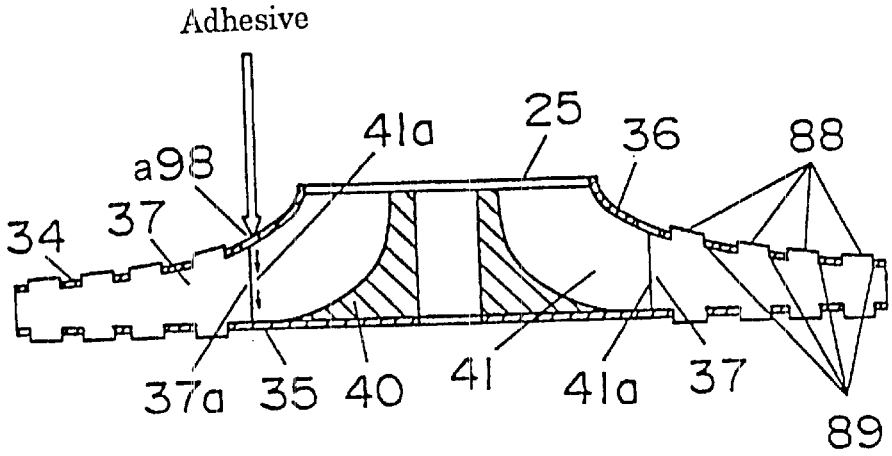
FIG. 25 is a sectional view of an impeller for an electric blower in accordance with a sixteenth exemplary embodiment of the present invention.
Figure 26:
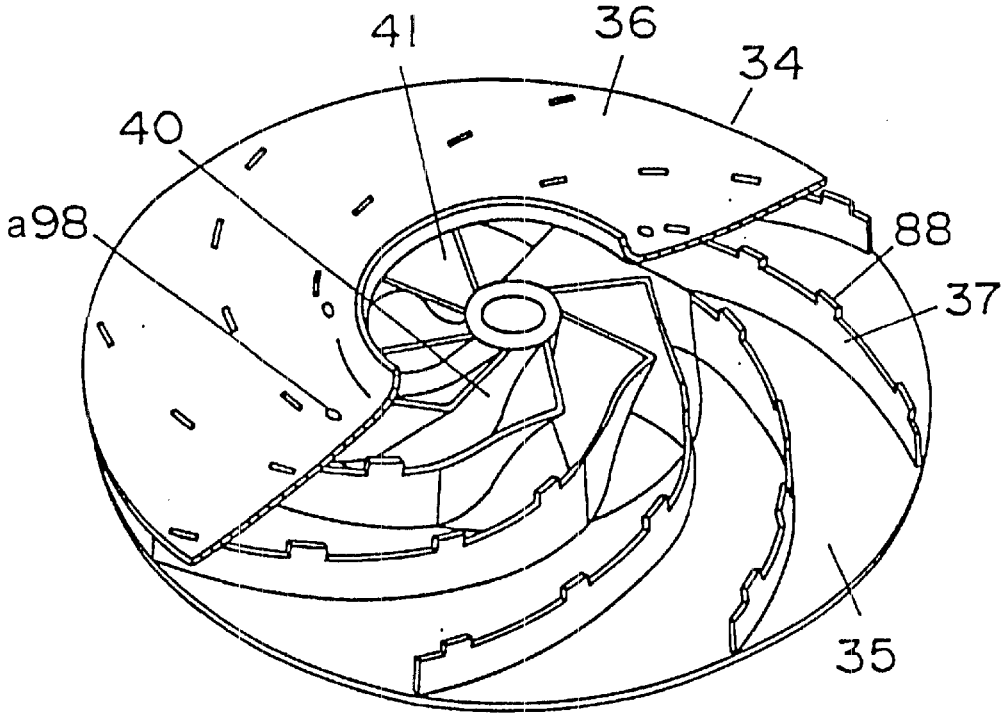
FIG. 26 is a partially-cut away perspective view of the same impeller in FIG. 25.

The sixteenth embodiment of the present invention is described hereinafter with reference to FIG. 25 and FIG. 26. The same elements as those in the embodiment discussed above are denoted with the same reference numbers, and description on them is eliminated.

Through hole a98 is drilled in front shroud 36 facing a joint portion between front edge 37*a* of blade 37 and rear edge 41 a of vane 41 of inducer 39.

An operation in this structure is described hereinafter.

During assembling of impeller 34, size variation and assembling variation of each component cause a micro clearance in the joint portion between front edge 37*a* of blade 37 and rear edge 41*a* of vane 41. However, when an adhesive is made to flow from through hole a98 in front shroud 36 using an automatic machine having a dispenser for coating liquid, the clearance is reduced and loss caused by air leakage can be reduced to improve efficiency. If the hole through front shroud 36 is remained opened, air flow leaks from the hole to reduce performance. Therefore, the hole must be blocked with the adhesive. As a result, an inner diameter of through hole a98 is preferably as small as possible, and a value smaller than about 1.2 mm is realistically adequate.

Through hole a98 is circular in the present invention, but a similar effect is obtainable even if the hole is square, for example, or rectangular.

Figure 27:
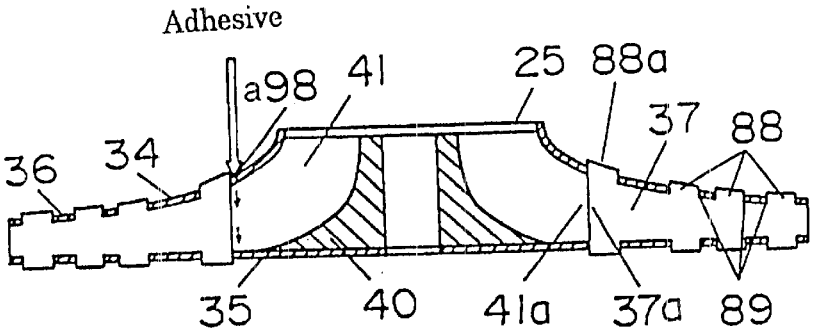
FIG. 27 is a sectional view of an impeller for an electric blower in accordance with a seventeenth exemplary embodiment of the present invention.

The seventeenth embodiment of the present invention is described hereinafter with reference to FIG. 27 and FIG. 28. The same elements as those in the embodiment discussed above are denoted with the same reference numbers, and description on them is eliminated.

Inner-side engaging portion 88*a* of a plurality of engaging portions 88 formed on blade 37 is placed at front edge 37*a* of blade 37.

An operation in this structure is described hereinafter.

During assembling of impeller 34, size variation and assembling variation of each component cause a micro clearance in the joint portion between front edge 37*a* of blade 37 and rear edge 41*a* of vane 41. When an adhesive is made to flow from through hole a98 formed in front shroud 36 in order to fill this clearance, the adhesive can be made to flow along inner-side engaging portion 88*a* projecting from the upper surface of front shroud 36. Therefore, the flowing-in position can be easily found to improve workability. The other operations are similar to the embodiment discussed above.

Figure 28:
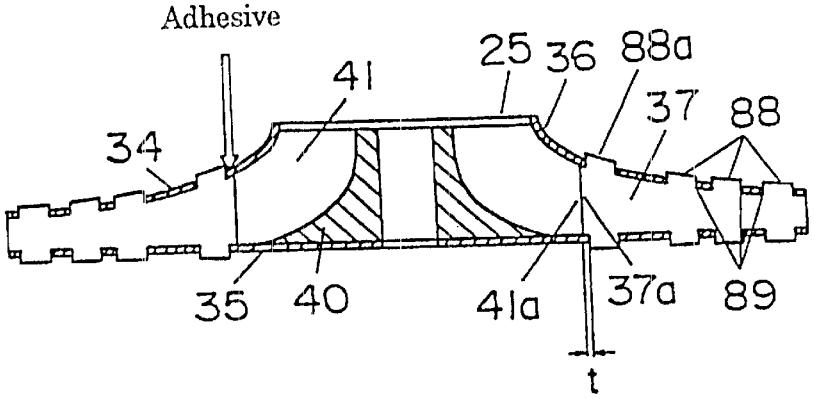
FIG. 28 is a sectional view showing another means of the same impeller in FIG. 27.

As shown in FIG. 28, when a distance (t) between engaging portion 88*a* placed on the inner side of blade 37 and the end surface of front edge 37*a* of blade 37 is set shorter than about 5 mm, engaging portion 88*a* is positioned in a slightly moderate part of the curved shape of front shroud 36. As a result, the improvement of the workability is not interfered, with engaging portion 88*a* is easily crimped, and strength of impeller 34 can be also ensured.

Figure 29:
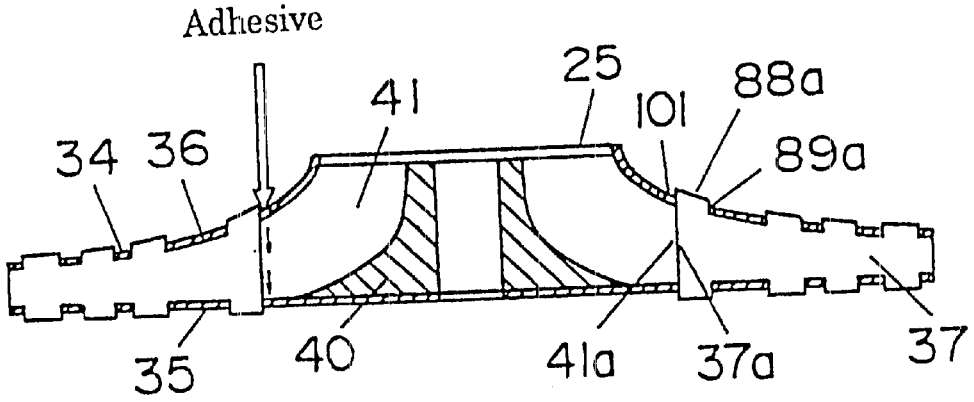
FIG. 29 is a sectional view of an impeller for an electric blower in accordance with an eighteenth exemplary embodiment of the present invention.

The eighteenth embodiment of the present invention is described hereinafter with reference to the drawings FIG. 29. The same elements as those in the embodiment discussed above are denoted with the same reference numbers, and description on them is eliminated.

Engaged portion 89*a* that is formed in front shroud 36 and is faced to inner-side engaging portion 88*a* placed on blade 37 is extended from the end position of front edge 37*a* of blade 37 toward inlet hole 25 in impeller 34 to define adhesive injecting portion 101.

An operation in this structure is described hereinafter.

When an adhesive is made to flow into a joint portion between vane 41 of inducer 39 and blade 37 to fill a clearance, the adhesive is easily made to flow along inside of inner-side engaging portion 88*a* from adhesive injecting portion 101 as the extending part of engaged portion 89*a* on the inlet hole 25 side of front shroud 36. Therefore, workability is improved, and a sufficient amount of adhesive can be made to flow in. The other operations are similar to the embodiment discussed above.

Figure 30:
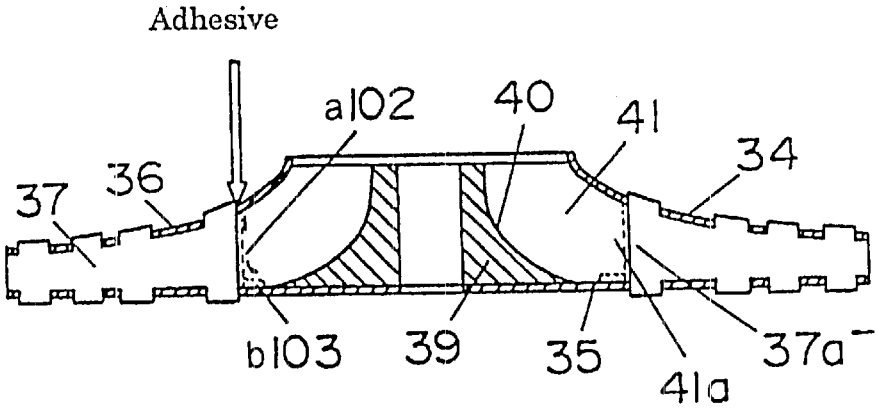
FIG. 30 is a sectional view of an impeller for an electric blower in accordance with a nineteenth exemplary embodiment of the present invention.
Figure 31:
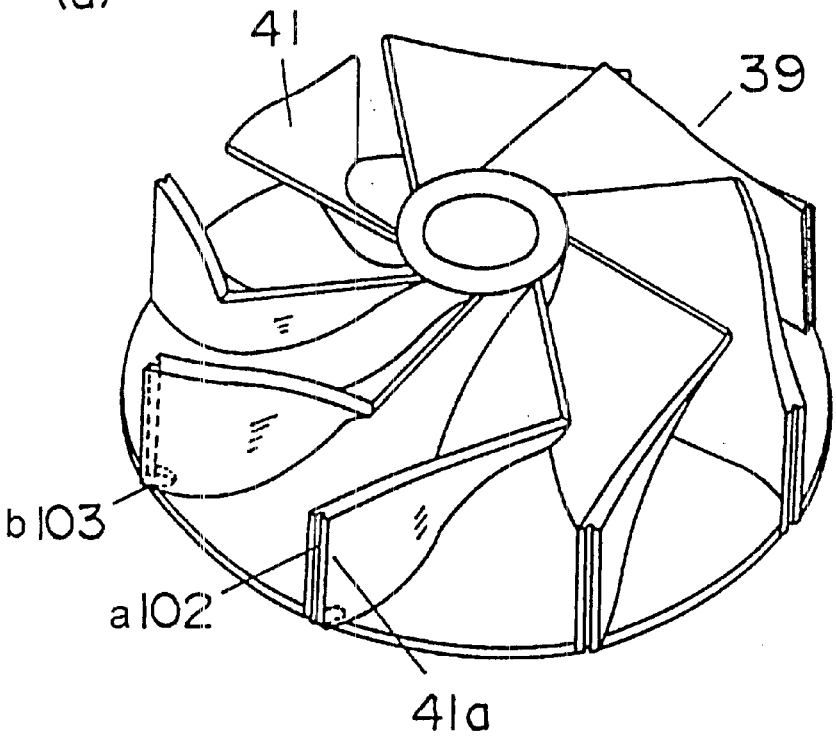
FIG. 31(*a*) is a perspective view of the same impeller in FIG. 30.
Figure 31:
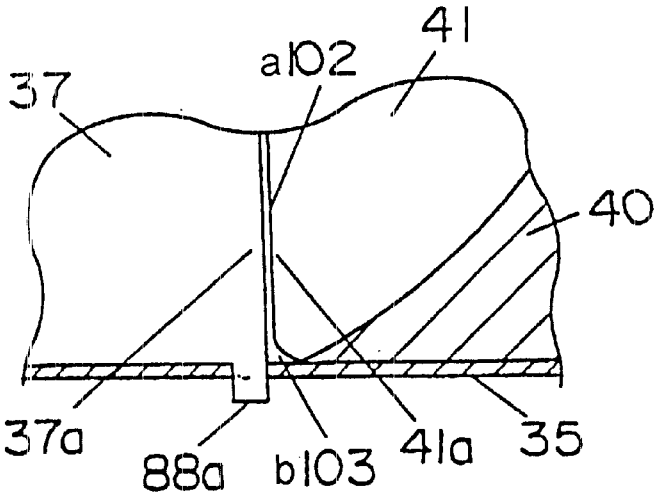

The nineteenth embodiment of the present invention is described hereinafter with reference to FIG. 30, FIG. 31(*a*), and FIG. 31(*b*). The same elements as those in the embodiment discussed above are denoted with the same reference numbers, and description on them is eliminated.

Groove a102 extending from front shroud 36 to rear shroud 35 is formed in the end of rear edge 41 a of vane 41 of inducer 39, which is joined to front edge 37*a* of blade 37.

Space portion b103 connecting to groove a102 is formed in the bottom facing rear shroud 35 of inducer 39.

An operation in this structure is described hereinafter.

When an adhesive is made to flow into a joint portion between rear edge 41 a of vane 41 of inducer 39 and front edge 37*a* of blade 37 to fill a clearance, the flowing-in adhesive penetrates along a space partitioned with groove a102 and the end surface of front edge 37*a* of blade 37 and can fill the clearance without being interfered with on the way.

Even when coating amount of the adhesive varies and too much adhesive is used, overflowing adhesive flows into space portion b103 formed in the bottom of inducer 39 to accumulate. Therefore, the possibility that the adhesive overflows into inner passage 92 in which air flows, disturbs air flow, and reduces sucking performance can be eliminated. The other operations are similar to the embodiment discussed above.

Figure 32:
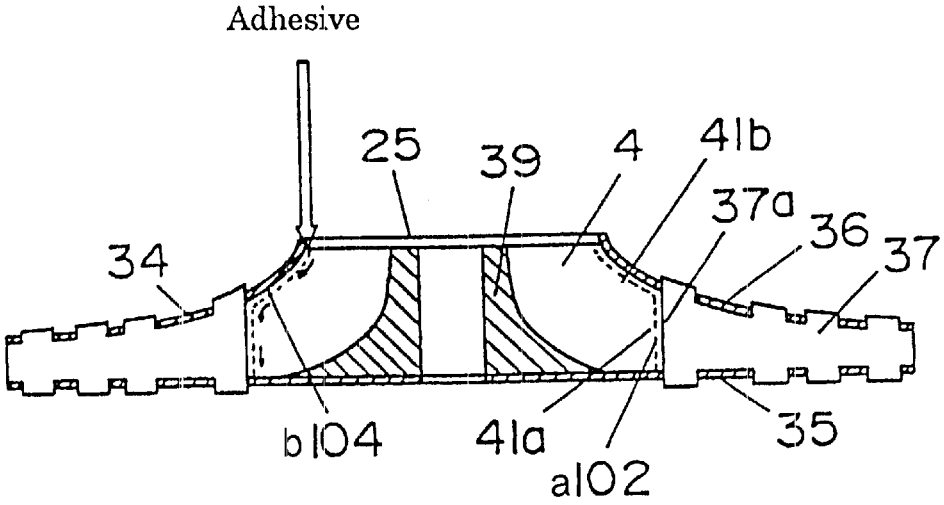
FIG. 32 is a sectional view of an impeller for an electric blower in accordance with a twentieth exemplary embodiment of the present invention.
Figure 33:
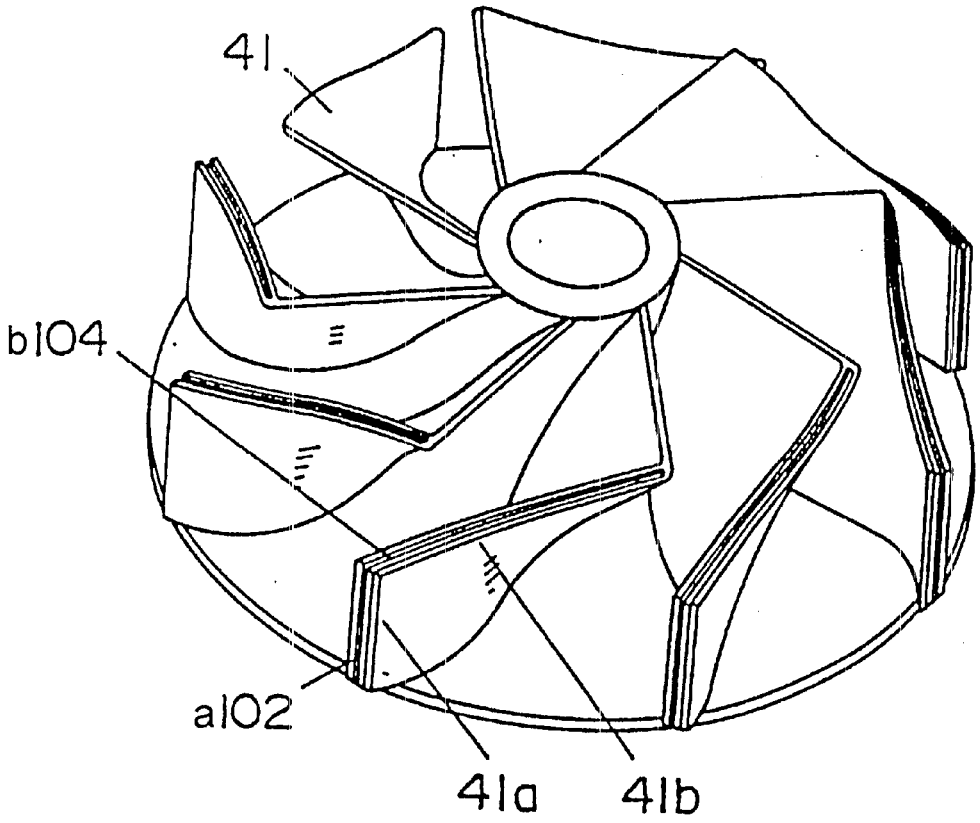
FIG. 33 is a perspective view of the same impeller in FIG. 32.

The twentieth embodiment of the present invention is described hereinafter with reference to FIG. 32 and FIG. 33. The same elements as those in the embodiment discussed above are denoted with the same reference numbers, and description on them is eliminated.

Groove b104 is formed from end 41*b* to rear edge 41*a* of vane 41 formed on inducer 39 abutting to front shroud 36.

An operation in this structure is described hereinafter.

When an adhesive is made to flow in from the inlet hole 25 side end of groove b104, the flowing-in adhesive travels along groove b104, is filled into a joint portion between end 41*b* of vane 41 on inducer 39 and front shroud 36 and a joint portion between rear edge 41*a* of vane 41 on inducer 39 and front edge 37*a* of blade 37, and is filled into the clearance. The other operations are similar to the embodiment discussed above.

The twenty-first embodiment of the present invention is described hereinafter with reference to FIG. 34. The same elements as those in the embodiment discussed above are denoted with the same reference numbers, and description on them is eliminated.

Through hole b108 is drilled through rear shroud 35 corresponding to a joint portion between front edge 37*a* of blade 37 and rear edge 41*a* of vane 41 placed on inducer 39.

An operation in this structure is described hereinafter.

Figure 34:
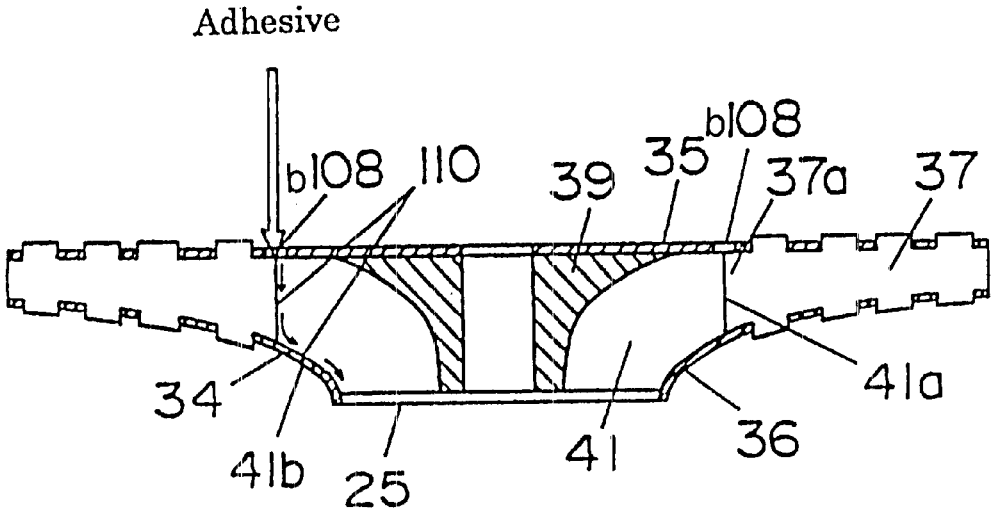
FIG. 34 is a sectional view of an impeller for an electric blower in accordance with a twenty-first embodiment of the present invention.

When an adhesive is filled into clearances 110 in a joint portion between rear edge 41*a* of vane 41 on inducer 39 and front edge 37*a* of blade 37 and a joint portion between end 41*b* of vane 41 and front shroud 36, the adhesive is made to flow in from through hole b 108 formed in rear shroud 35 in the state that inlet hole 25 of impeller 34 is directed downward as shown in FIG. 34. Thus, clearances 110 can be filled. The other operations are similar to the embodiment discussed above.

Figure 35:
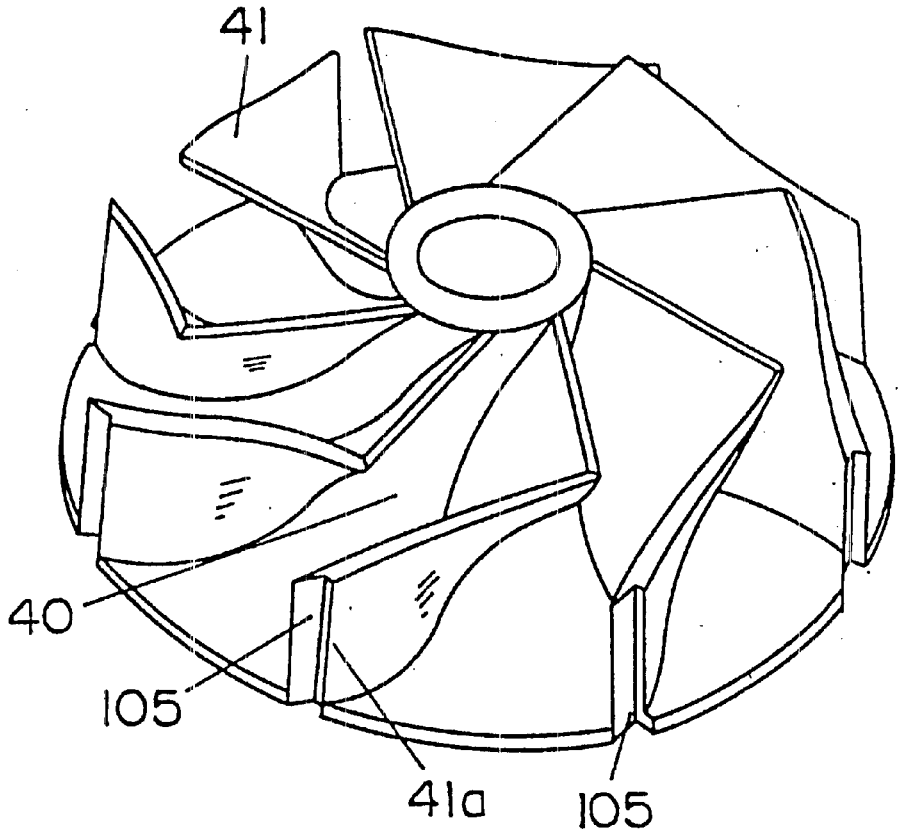
FIG. 35(*a*) is a perspective view of an inducer for an electric blower in accordance with a twenty-second exemplary embodiment of the present invention.
Figure 35:
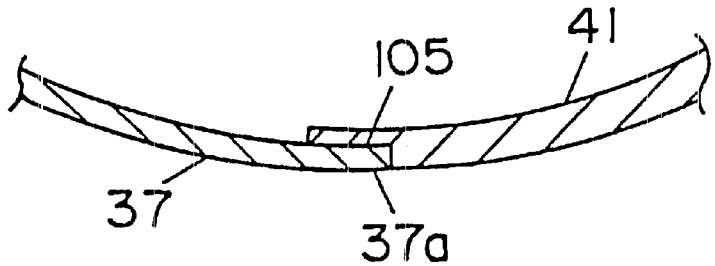

The twenty-second embodiment of the present invention is described hereinafter with reference to FIG. 35(*a*) and FIG. 35(*b*). The same elements as those in the embodiment discussed above are denoted with the same reference numbers, and description on them is eliminated.

Substantially-L-shaped notch 105 is formed in a joint portion between front edge 37*a* of blade 37 and rear edge 41*a* of vane 41, in hub 40 of inducer 39.

An operation in this structure is described hereinafter.

When impeller 34 is temporarily assembled, inducer 39 is first mounted to rear shroud 35. Next, front edge 37*a* of blade 37 is joined to rear edge 41*a* of vane 41 of inducer 39, and simultaneously, a plurality of engaging portions 88 formed on blade 37 are inserted into a plurality of engaged portions 89 formed in rear shroud 35 facing the engaging portions. At this time, since substantially-L-shaped notch 105 is formed in rear edge 41*a* of vane 41, the joint portion can abut to not only the end surface, but also a side surface of front edge 37*a* of blade 37 as shown in FIG. 35(*b*), and leakage of air flow at the joint portion can be reduced. In addition, since notch 105 is substantially-L-shaped, assembling is facilitated and loss of workability is eliminated. The other operations are similar to the embodiment discussed above.

Figure 36:
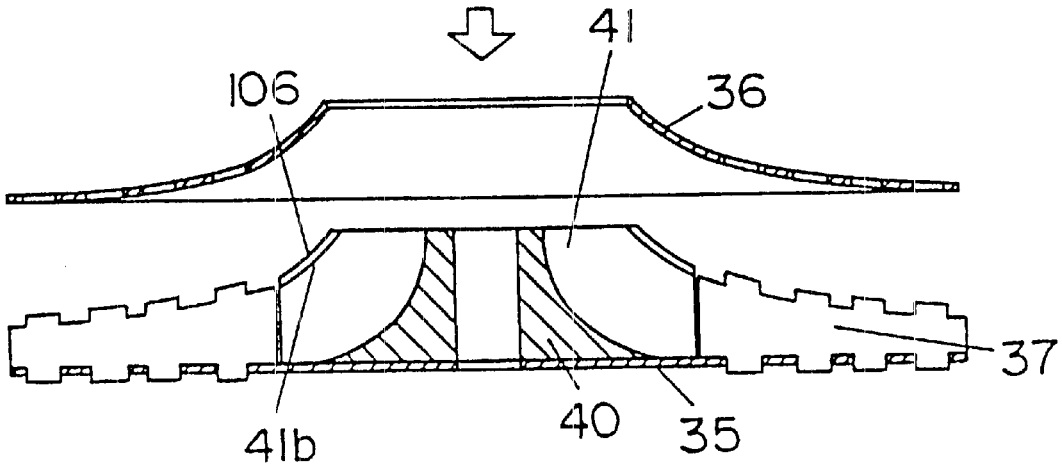
FIG. 36 is an exploded sectional view of an impeller for an electric blower in accordance with a twenty-third exemplary embodiment of the present invention.
Figure 37:
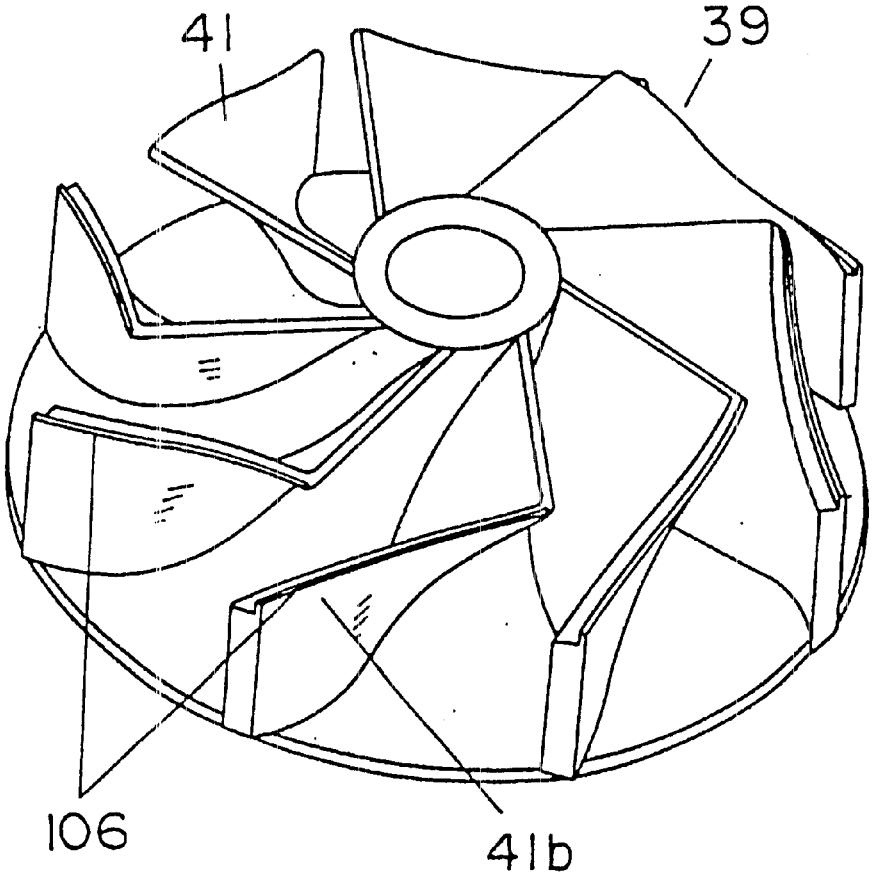
FIG. 37 is a perspective view of an inducer in the same impeller in FIG. 36.

The twenty-third embodiment of the present invention is described hereinafter with reference to FIG. 36 and FIG. 37.

The same elements as those in the embodiment discussed above are denoted with the same reference numbers, and description on them is eliminated.

Flash 106 is formed at end 41*b* joining with front shroud 36 of vane 41 of inducer 39.

An operation in this structure is described hereinafter.

When impeller 34 is assembled, a plurality of engaging portions 88 formed on blade 37 are pressurized and crushed to be fixed to front shroud 36 and rear shroud 35, and simultaneously, flexible and thin flash 106 formed at end 41 b of vane 41 is pressurized and crushed to certainly fill in a clearance in a joint surface. The other operations are similar to the embodiment discussed above.

Figure 38:
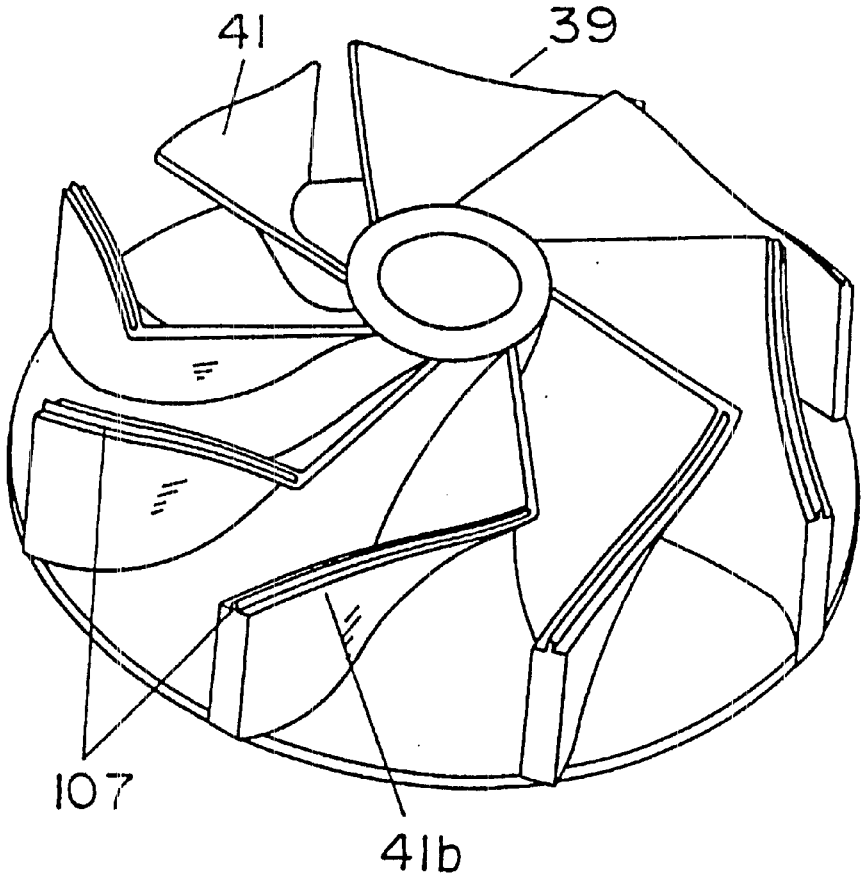
FIG. 38 is a perspective view of an inducer in an impeller for an electric blower in accordance with a twenty-fourth exemplary embodiment of the present invention.

The twenty-fourth embodiment of the present invention is described hereinafter with reference to FIG. 38. The same elements as those in the embodiment discussed above are denoted with the same reference numbers, and description on them is eliminated.

Micro rib 107 is formed at end 41*b* joining with front shroud 36 of vane 41 of inducer 39.

An operation in this structure is described hereinafter.

When impeller 34 is assembled, a plurality of engaging portions 88 formed on blade 37 are pressurized and crushed to be fixed to front shroud 36 and rear shroud 35, and simultaneously, flexible and micro rib 107 is pressurized and crushed to certainly fill in a clearance in a joint surface. The other operations are similar to the embodiment discussed above.

Figure 39:
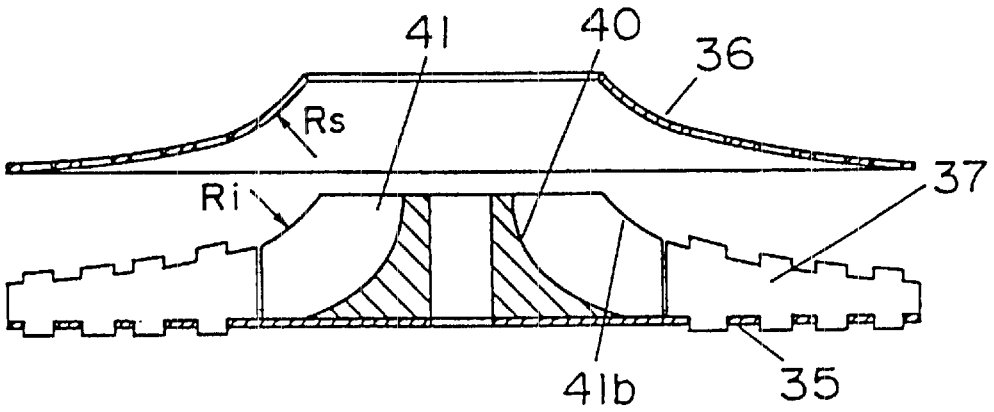
FIG. 39 is an exploded sectional view of an impeller for an electric blower in accordance with a twenty-fifth exemplary embodiment of the present invention.

The twenty-fifth embodiment of the present invention is described hereinafter with reference to FIG. 39. The same elements as those in the embodiment discussed above are denoted with the same reference numbers, and description on them is eliminated.

A relation between radius Rs of a curved portion of front shroud 36 joining with end 41*b* of vane 41 formed on inducer 39 and radius Ri of a curved line of end 41*b* of vane 41 is set as $Ri \leqq Rs$.

An operation in this structure is described hereinafter.

When impeller 34 is assembled, curved-face radius of front shroud 36 is enlarged. Therefore, when front shroud 36 is pressurized, front shroud 36 deforms to widely abut to a curved portion of vane 41. As a result, a clearance between vane 41 and front shroud 36 can be reduced. The other operations are similar to the embodiment discussed above.

The twenty-sixth embodiment of the present invention is described hereinafter with reference to FIG. 40. The same elements as those in the embodiment discussed above are denoted with the same reference numbers, and description on them is eliminated.

A relation between height Hi of rear edge 41 a of vane 41 formed on inducer 39 and height Hb of front edge 37*a* of blade 37 is set as $Hi \geqq Hb$.

An operation in this structure is described hereinafter.

Figure 40:
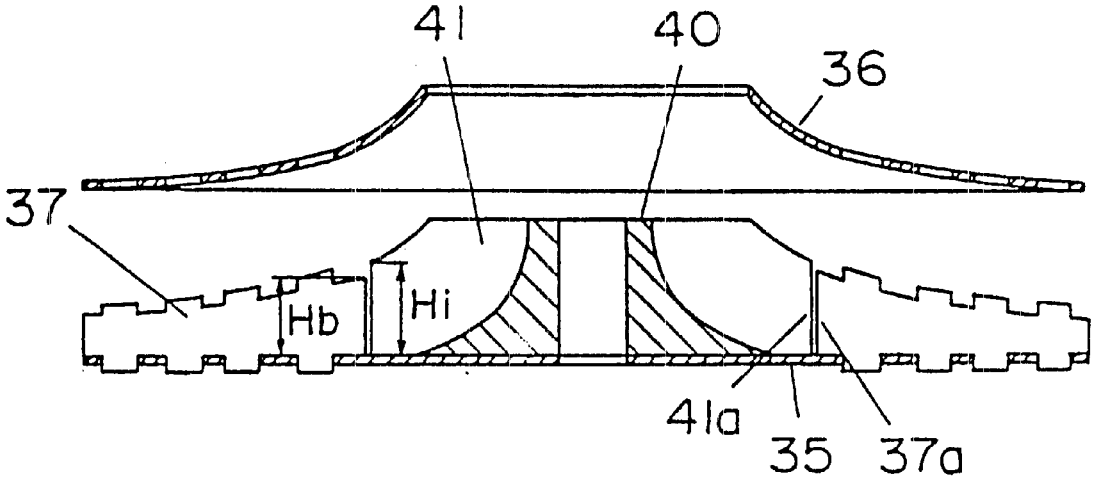
FIG. 40 is an exploded sectional view of an impeller for an electric blower in accordance with a twenty-sixth exemplary embodiment of the present invention.

When front shroud 36 is put in a state that inducer 39 and blade 37 are temporarily assembled on rear shroud 35 during assembling of impeller 34 as shown in FIG. 40, front shroud 36 joins to vane 41 of inducer 39 always prior to other parts. When pressurization is continued, vane 41 deforms so as to be crushed to decrease Hi because vane 41 is made of resin. When Hi becomes equal to Hb, front shroud 36 joins to blade 37. As a result, a clearance between front shroud 36 and end 41*b* of vane 41 can be certainly filled. The other operations are similar to the embodiment discussed above.

The twenty-seventh embodiment of the present invention is described hereinafter with reference to FIG. 41 and FIG. 42. The same elements as those in the embodiment discussed above are denoted with the same reference numbers, and description on them is eliminated.

There was a problem that size dispersion of respective components and assembling dispersion cause micro clearance 116 in each joint portion, this clearance causes air leakage to reduce performance of impeller 34. Conventionally, a dipping method for dipping entire impeller 34 into an adhesive is employed for solving the problem. However, partial stagnation of the adhesive occurs after drying, and it may cause unbalance in impeller 34.

Figure 41:
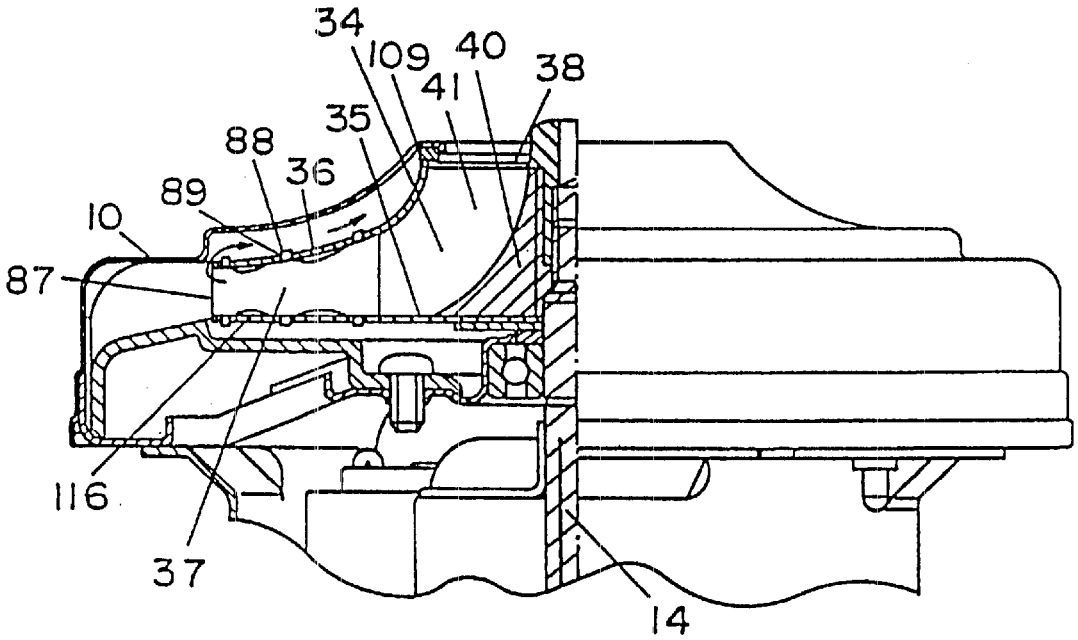
FIG. 41 is a partially-cut away side view of an important part of an electric blower in accordance with a twenty-seventh exemplary embodiment of the present invention.
Figure 42:
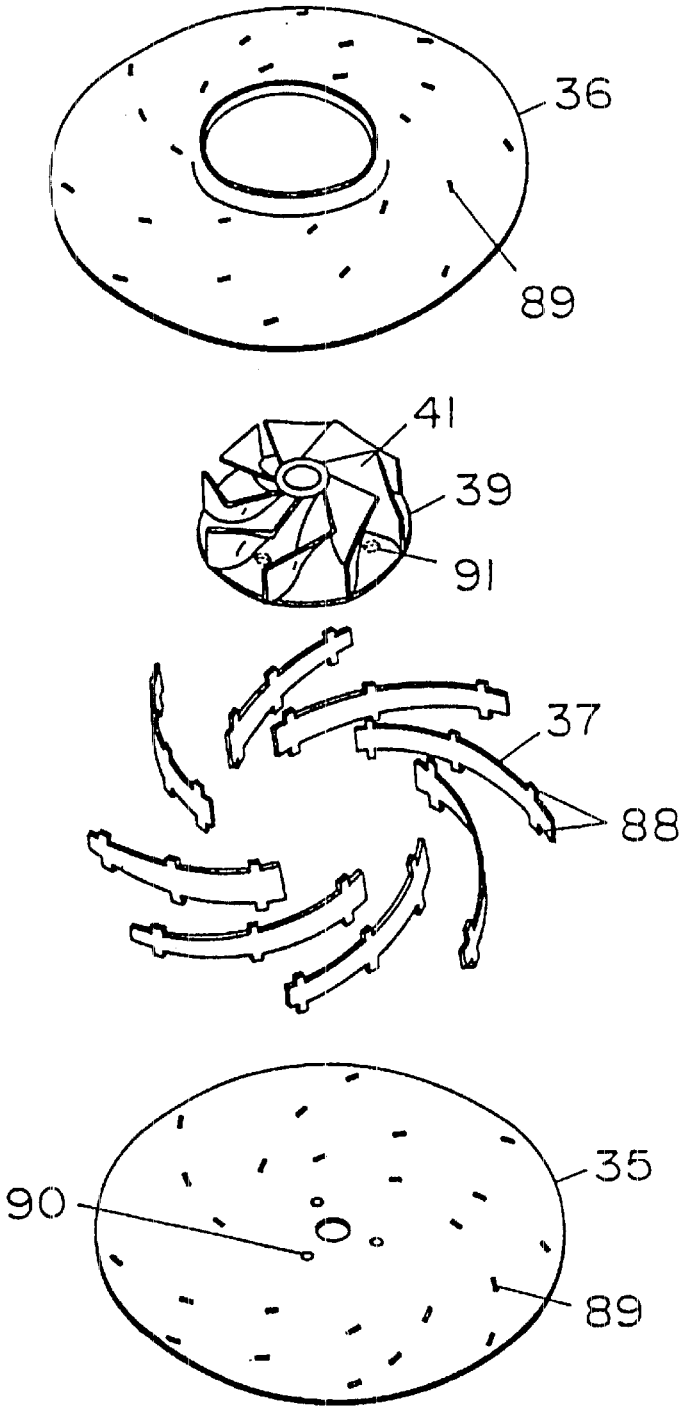
FIG. 42 is an exploded perspective view showing an assembling work of an impeller in FIG. 41.

In the present embodiment, as shown in FIG. 41 and FIG. 42, front shroud 36 and rear shroud 35 are formed from thin metal plates, and respective joint portions among front shroud 36, rear shroud 35, inducer 39, hub 40, vane 41, blade 37 are coated with adhesives. The adhesives prevent leakage to improve performance, and coating amount of the adhesives is controlled based on a general standard to prevent stagnation of the adhesives. The other operations are similar to the embodiment discussed above.

Figure 43:
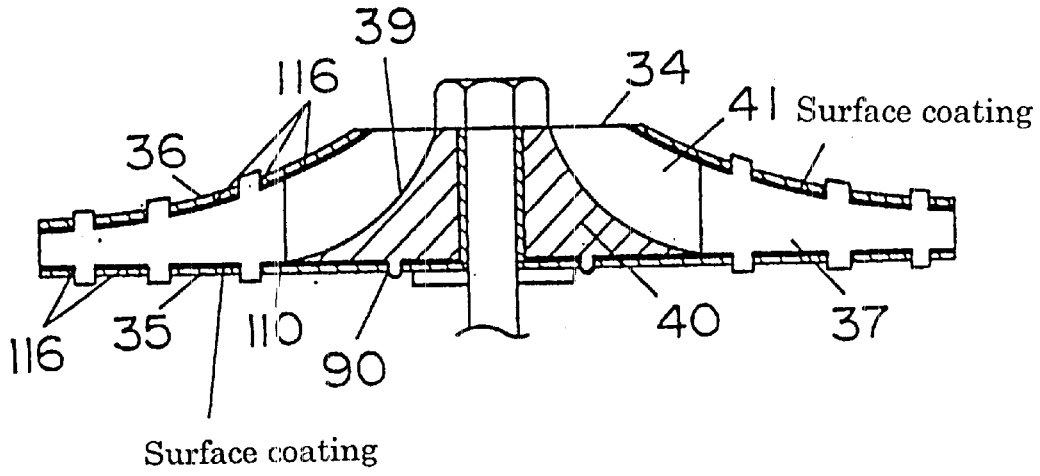
FIG. 43 is a sectional view of an impeller for an electric blower in accordance with a twenty-eighth exemplary embodiment of the present invention.

The twenty-eighth embodiment of the present invention is described hereinafter with reference to FIG. 43. The same elements as those in the embodiment discussed above are denoted with the same reference numbers, and description on them is eliminated.

Surface coating that is melted by heat to provide adhesive effect is applied to the inner surfaces of front shroud 36 and rear shroud 35 are formed from thin metal plates.

An operation in this structure is described hereinafter.

In a crimp process between front shroud 36 or rear shroud 35 and blade 37, workability can be further improved and micro clearance 116 among all joint portions can be filled by heating them simultaneously. In addition, as a method for coating the entire components certainly uniformly, coating using an electrostatic method or an electrodeposition method is employed. This method can certainly fill the clearance without causing any problem on workability or unbalance. The other operations are similar to the embodiment discussed above.

Figure 44:
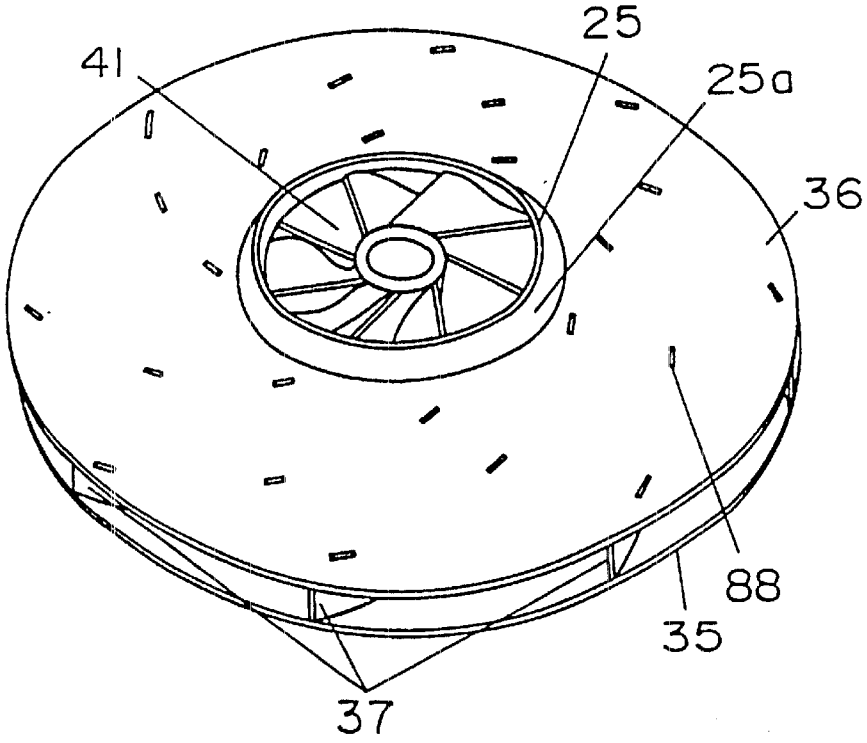
FIG. 44 is a perspective view showing coating of an impeller for an electric blower in accordance with a twenty-ninth exemplary embodiment of the present invention.

The twenty-ninth embodiment of the present invention is described hereinafter with reference to FIG. 41 and FIG. 44. The same elements as those in the embodiment discussed above are denoted with the same reference numbers, and description on them is eliminated.

As shown in FIG. 41, seal member 109 slidably abutting to inlet hole 25 of front shroud 36 is placed on the inner surface of intake opening 11 of fan case 10.

When an adhesive or coating is spread on impeller 34, frictional resistance may increase during the sliding of it on seal member 109 to reduce performance. In this case, as shown in FIG. 44, the proximity 25*a* of inlet hole 25 of slidable front shroud 36 is masked so as to not receive coating during coating. Thus, the frictional resistance can be prevented from increasing without changing the seal effect between seal member 109 and front shroud 36.

An operation in this structure is described hereinafter.

Air flow discharged from exhaust opening 87 formed in the outer periphery of impeller 34 can be prevented from, as circulating flow (arrow), partially flowing into a space between fan case 10 and impeller 34. Therefore, performance of electric blower 12 is improved. The other operations are similar to the embodiment discussed above.

The thirtieth embodiment of the present invention is described hereinafter with reference to FIG. 45.

Figure 45:
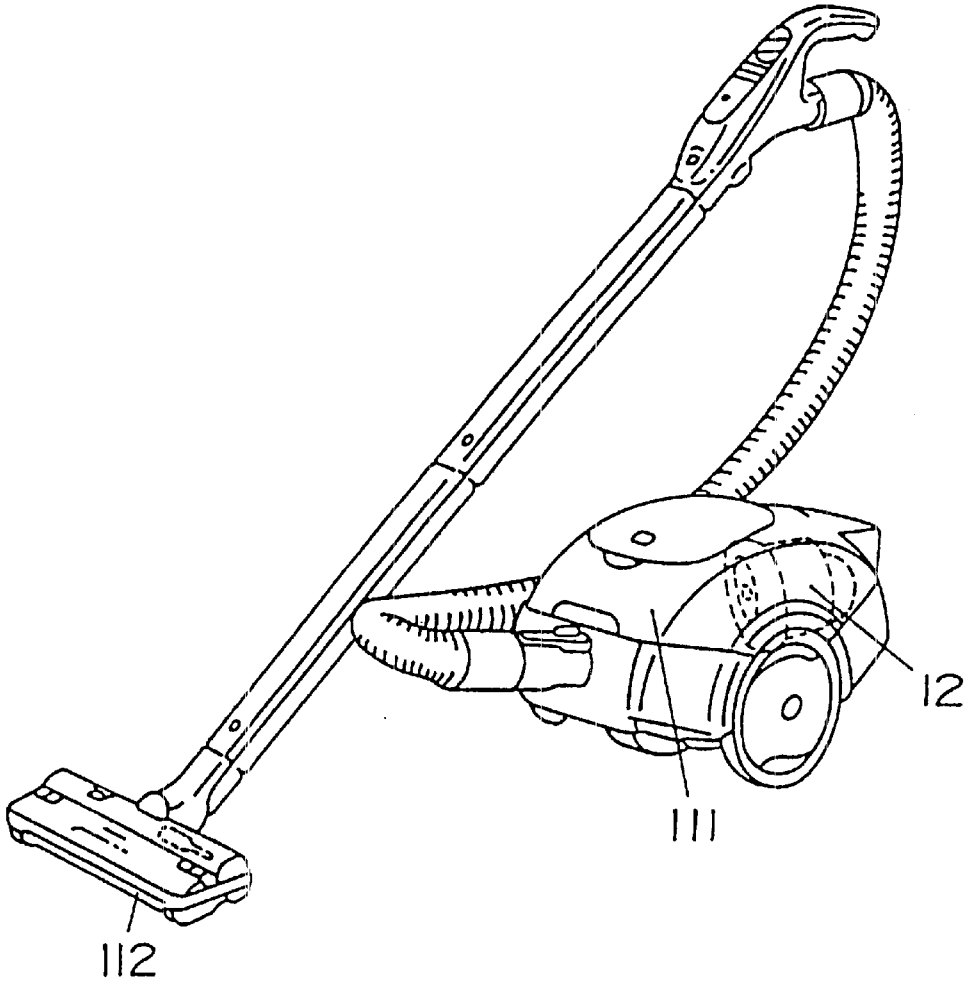
FIG. 45 is a perspective view of a vacuum cleaner using an electric blower having an impeller in accordance with the present invention.
Figure 46:
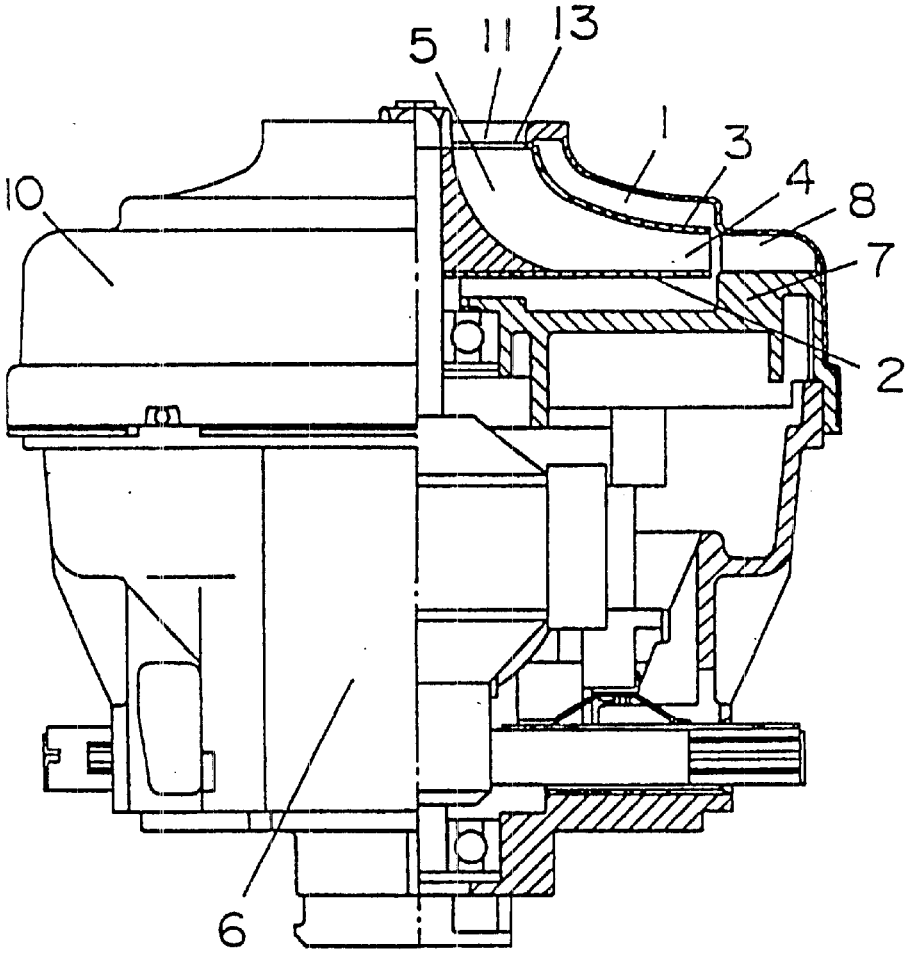
FIG. 46 PRIOR ART
FIG. 46 is a partial sectional view of a conventional electric blower.

FIG. 45 shows an entire vacuum cleaner, its body has built-in dust collector 111 for collecting dusts and electric blower 12 described in the first to twenty-ninth embodiments. Suction portion 1 12 is communicated with dust collector 111.

An operation in this structure is described hereinafter.

A resin-made inducer capable having an ideal three-dimensional curved surface causes direction of axially sucked air flow to transfer to a direction orthogonal to the axis, eliminates micro clearance in joint portions between respective components constituting impeller 34, and improves strength and assembling ability. Since such electric blower high in sucking performance and reliability is built in the vacuum cleaner, a practical vacuum cleaner high in sucking performance can be provided.

INDUSTRIAL APPLICABILITY

In the present invention, an air flow passage in an impeller is divided into an inducer part in a three-dimensional curved surface shape and a blade part in a two-dimensional curved surface shape. Therefore, a configuration, a structure, and a manufacturing method optimal to each part can be employed, problems on strength, clearance, and air resistance are resolved, and a highly efficient electric blower can be realized. In addition, a vacuum cleaner high in sucking performance employing this electric blower can be provided.

What is claimed is:

1. An electric blower comprising an electric motor having a rotating shaft and an impeller fixed to the rotating shaft for rotation, wherein said impeller comprises:

a rear shroud fixed to the rotating shaft;

a front shroud having an inlet hole for air, said front shroud facing said rear shroud;

a plurality of blades disposed between said front shroud and said rear shroud; and an inducer adapted to streamline air flowing in from the inlet hole and having a hub and a plurality of vanes integrally formed on said hub, wherein said inducer is formed separately from said plurality of blades and abuts against said front shroud and said rear shroud.

2. An electric blower according to claim 1, wherein said rear shroud and said front shroud are formed from thin metallic plates.

3. An electric blower according to claim 2, wherein said inducer is molded with a plurality of divided dies which slide substantially radially.

4. An electric blower according to claim 3, wherein a direction of a line between a point at a tip of each of said plurality of vanes of said inducer and a point moved by a clearance from an end of an outer periphery of each of said plurality of vanes is matched to a sliding direction of each of the plurality of dies, respectively.

5. An electric blower according to claim 4, wherein said hub is substantially conical and said plurality of vanes are fixed to an outer periphery of said hub and have a three-dimensional-shaped curved surface and a parting line, said plurality of vanes being adapted such that air flow at an upstream side thereof is higher than at a downstream side thereof.

6. An electric blower according to claim 4, wherein each of said plurality of vanes has a connecting portion located at a blade-side end of said inducer for connecting with an end of a respective one of said plurality of blades.

7. An electric blower according to claim 3, wherein each of said plurality of vanes has a connecting portion located at a blade-side end of said inducer for connecting with an end of a respective one of said plurality of blades.

8. An electric blower according to claim 3, wherein a number of said plurality of vanes and a number of said plurality of blades are six, respectively.

9. An electric blower according to claim 3, wherein said hub is substantially conical and said plurality of vanes are fixed to an outer periphery of said hub and have a three-dimensional-shaped curved surface and a parting line, said plurality of vanes being adapted such that air flow at an upstream side thereof is higher than at a downstream side thereof.

10. A vacuum cleaner having a dust collector for collecting dust, a suction portion communicating with the dust collector, and an electric blower according to claim 3.

11. An electric blower according to claim 2, wherein a number of said plurality of vanes and a number of said plurality of blades are six, respectively.

12. An electric blower according to claim 11, wherein said hub is substantially conical and said plurality of vanes are fixed to an outer periphery of said hub and have a three-dimensional-shaped curved surface and a parting line, said plurality of vanes being adapted such that air flow at an upstream side thereof is higher than at a downstream side thereof.

13. An electric blower according to claim 11, wherein each of said plurality of vanes has a connecting portion located at a blade-side end of said inducer for connecting with an end of a respective one of said plurality of blades.

14. An electric blower according to claim 2, wherein said hub is substantially conical and said plurality of vanes are fixed to an outer periphery of said hub and have a three-dimensional-shaped curved surface and a parting line, said plurality of vanes being adapted such that air flow at an upstream side thereof is higher than at a downstream side thereof.

15. An electric blower according to claim 14, wherein each of said plurality of vanes has a connecting portion located at a blade-side end of said inducer for connecting with an end of a respective one of said plurality of blades.

16. An electric blower according to claim 2, wherein each of said plurality of vanes has a connecting portion located at a blade-side end of said inducer for connecting with an end of a respective one of said plurality of blades.

17. An electric blower according to claim 16, wherein each of said connecting portions has a recessed part for receiving said end of said respective one of said plurality of blades.

18. An electric blower according to claim 17, wherein said ends of said plurality of blades are pressed into the recessed parts of said connecting portions, respectively.

19. An electric blower according to claim 16, wherein said connecting portions are abutted to a reversely-rotated side surface of said ends of said plurality of blades, respectively.

20. An electric blower according to claim 16, wherein said connecting portions and an inlet-side end of said plurality of blades are integrally formed, respectively.

21. An electric blower according to claim 2, wherein said plurality of vanes are fixed to an outer periphery of said hub and have a three-dimensional-shaped curved surface, said rear shroud has at least one engaged portion, said hub has at least one engaging portion formed at a rear shroud side thereof, and said at least one engaging portion of said hub is engaged with said at least one engaged portion of said rear shroud.

22. The electric blower according to claim 21, wherein said at least one engaging portion of said hub is formed as a boss and said at least one engaged portion of said rear shroud is formed as a hole.

23. An electric blower according to claim 22, wherein said boss has a tilting portion formed at a tip thereof, an outer diameter of a root portion of said tilting portion of said boss is smaller than a diameter of the hole in said rear shroud, and an outer diameter of a root portion of said boss being is larger than the diameter of the hole.

24. An electric blower according to claim 22, wherein said rear shroud has a plurality of long holes, a maximum diameter portion of one of the plurality of long holes being larger than a diameter of said boss, and minimum diameter portion of another of the plurality of long holes being smaller than the diameter of said boss.

25. The electric blower according to claim 22, wherein a number of said at least one engaging portion of said hub and a number of said at least one engaged portion are respectively equal to a divisor of a number of said plurality of blades or said plurality of vanes.

26. An electric blower according to claim 21, wherein said at least one engaging portion on said hub is a boss, and said boss is higher than said engaging portions on said plurality of blades.

27. The electric blower according to claim 21, wherein a number of said at least one engaging portion of said hub and a number of said at least one engaged portion of said rear shroud are respectively equal to a divisor of a number of said plurality of blades or said plurality of vanes.

28. An electric blower according to claim 2, wherein said plurality of vanes are fixed to an outer periphery of said hub and have a three-dimensional-shaped curved surface, and a rear shroud side of said hub defines a space portion such that a thickness of said hub is substantially uniform.

29. An electric blower according to claim 28, further comprising a plurality of ribs radially located in the space portion, wherein said inducer has a boss portion formed at a center thereof and said plurality of ribs are connected to said boss portion.

30. An electric blower according to claim 29, wherein at least one of said plurality of ribs has a boss capable of engaging with a hole formed in said rear shroud.

31. An electric blower according to claim 2, wherein said rear shroud has a plurality of projecting parts, and a bottom surface of said hub has a plurality of recessed parts engaged with said plurality of projecting parts.

32. An electric blower according to claim 2, wherein at least one of an upper part and a lower part of a rear edge of at least one of said plurality of vanes has a projection formed thereon, a front edge of at least one of said plurality of blades has an engaging portion formed thereon, said engaging portion is joined to said at least one projection, and said front shroud and said rear shroud are fixed by simultaneously crimping said at least one projection and said engaging portion.

33. An electric blower according to claim 2, wherein said front shroud has a through hole located therein in a position that corresponds to a joint portion between an end of one of said plurality of blades and an end of a corresponding one of said plurality of vanes of said inducer.

34. An electric blower according to claim 33, wherein an end of a rear edge of each of said plurality of vanes of said inducer has a groove extending from said front shroud to said rear shroud.

35. An electric blower according to claim 34, wherein a bottom portion of said inducer has a plurality of spaces formed therein, the spaces being respectively connected with the grooves formed in said end of said rear edge of each of said plurality of vanes.

36. An electric blower according to claim 2, wherein said plurality of blades have a plurality of engaging portions engaged with said front shroud and said rear shroud, and at least one of said plurality of engaging portions is located at an inducer side end of each of said plurality of blades.

37. An electric blower according to claim 36, wherein an end of a rear edge of each of said plurality of vanes of said inducer has a groove extending from said front shroud to said rear shroud.

38. An electric blower according to claim 2, wherein a central side of each of said plurality of blades has an engaging portion formed thereon, and a distance between a front edge of each of said plurality of blades and an end of said engaging portion respectively on each of said plurality of blades is shorter than 5 mm.

39. An electric blower according to claim 36, wherein a central side of each of said plurality of blades has an engaging portion formed thereon, and said front shroud has a plurality of engaged portions extending towards a suction opening of said impeller, said plurality of engaged portions being engaged with said engaging portions at said central sides of said plurality of blades.

40. An electric blower according to claim 39, wherein an end of a rear edge of each of said plurality of vanes of said inducer has a groove extending from said front shroud to said rear shroud.

41. An electric blower according to claim 38, wherein a central side of each of said plurality of blades has an engaging portion formed thereon, and said front shroud has a plurality of engaged portions extending towards a suction opening of said impeller, said plurality of engaged portioned being engaged with said engaging portions at said central side of said plurality of blades.

42. An electric blower according to claim 38, wherein an end of a rear edge of each of said plurality of vanes of said inducer has a groove extending from said front shroud to said rear shroud.

43. An electric blower according to claim 2, wherein each of said plurality of vanes has a groove formed therein from an end of each of said plurality of vanes to a rear edge of each of said plurality of vanes that abuts said front shroud, respectively.

44. An electric blower according to claim 2, wherein said rear shroud has a plurality of through holes positioned to correspond to joint portions between an end of each of said plurality of blades and an end of each of said plurality of vanes of said inducer, respectively.

45. A vacuum cleaner having a dust collector for collecting dust, a suction portion communicating with the dust collector, and an electric blower according to claim 2.

46. A vacuum cleaner having a dust collector for collecting dust, a suction portion communicating with the dust collector, and an electric blower according to claim 1.

47. An electric blower according to claim 1, wherein said plurality of vanes are not projecting from the inlet hole.

48. An electric blower according to claim 1, wherein said inducer is made from a moldable plastic resin.

49. An electric blower comprising:

a rear shroud fixed to a rotating shaft of an electric motor;

a front shroud facing said rear shroud;

a plurality of blades disposed between said front shroud and said rear shroud;

an inducer having a plurality of vanes extending from said plurality of blades toward an inlet of an impeller; and a hub defining a base of said inducer, wherein each of said plurality of vanes has a substantially L-shaped notch formed in a root part on an outer periphery side thereof, the substantially L-shaped notch being located in a joint portion between a front edge of each of said plurality of blades and a rear edge of each of said plurality of vanes, respectively.

50. An electric blower according to claim 49, wherein an end of each of said plurality of vanes joined to said front shroud has a flash formed thereat.

51. An electric blower according to claim 49, wherein a front-shroud-side end of each of said plurality of vanes has a micro rib formed thereat.

52. An electric blower according to claim 51, wherein a curved surface of said frond shroud having a radius Rs is joined with a curve of each of said plurality of vanes formed on said inducer having a radius Ri, such that a relation $Ri \leqq Rs$ is satisfied.

53. An electric blower according to claim 52, wherein a rear edge of each of said plurality of vanes has a height Hi, and a front edge of each of said plurality of blades joined to said read edge of a respective one of said plurality of vanes has a height Hb, such that a relation $Hi \geqq Hb$ is satisfied.

54. An electric blower comprising an electric motor having a rotating shaft and an impeller fixed to the rotating shaft for rotation, said impeller comprising:

a rear shroud fixed to the rotating shaft;

a front shroud facing said rear shroud and having an inlet hole in a center of said front shroud;

a plurality of blades being held between said rear shroud and said front shroud; and an inducer having a plurality of vanes, said inducer abutting against said rear shroud and said front shroud, wherein said rear shroud and said front shroud are respectively formed from metallic plates, and said front shroud, said rear shroud, said inducer, said plurality of vanes, and said plurality of blades have a plurality of joint portions held together with an adhesive.

55. An electric blower comprising an electric motor having a rotating shaft and an impeller fixed to the rotating shaft for rotation, said impeller comprising:

a rear shroud fixed to the rotating shaft;

a front shroud facing said rear shroud and having an inlet hole in a center of said front shroud;

a plurality of blades held between said rear shroud and said front shroud; and an inducer extending from an inside end of each of said plurality of blades and having a plurality of vanes, wherein said rear shroud and said front shroud are respectively formed from metal plates, and a coating that is melted by heat to provide an adhesive effect is applied to said front shroud and said rear shroud.

56. An electric blower comprising an electric motor having a rotating shaft and an impeller fixed to the rotating shaft for rotation, said impeller comprising:

a rear shroud fixed to the rotating shaft;

a front shroud facing said rear shroud and having an inlet hole in a center of said front shroud;

a plurality of blades held between said rear shroud and said front shroud; and an inducer extending from an inside end of each of said plurality of blades and having a plurality of vanes, wherein said rear shroud and said front shroud are respectively formed from metallic plates, and at least entire surfaces of both said first shroud and said second shroud are coated.

57. An electric blower comprising:

an electric motor having a rotating shaft;

an impeller fixed to said rotating shaft for rotation;

an air guide disposed facing an exhaust opening formed in an outer periphery of said impeller; and a fan case for covering said impeller and said air guide, wherein said impeller comprises:

a rear shroud fixed to said rotating shaft;

a front shroud facing said rear shroud and having an inlet hole in a center of said front shroud;

a plurality of blades held between said rear shroud and said front shroud;

an inducer extending from an inside end of said plurality of blades and having a plurality of vanes, said inducer abutting against said front shroud and said rear shroud; and a seal member slidably abutting to the inlet hole of said front shroud, said seal member being mounted to an inner surface of said fan case facing the inlet hole.

58. An electric blower according to claim 57, wherein a part of said front shroud slidably abutting to said seal member and a proximity of said part are not coated.

* * * * *